United States Patent [19]

Sakanoue et al.

[11] Patent Number: 4,489,155

[45] Date of Patent: Dec. 18, 1984

[54] SILVER HALIDE COLOR PHOTOGRAPHIC MATERIALS WITH DIFFUSIBLE DYE FOR IMPROVING GRAININESS

[75] Inventors: Kei Sakanoue; Shigeo Hirano; Keiichi Adachi, all of Kanagawa, Japan

[73] Assignee: Fuji Photo Film Co., Ltd., Kanagawa, Japan

[21] Appl. No.: 511,030

[22] Filed: Jul. 5, 1983

[30] Foreign Application Priority Data

Jul. 7, 1982 [JP] Japan ..... 57-118161

[51] Int. Cl.[3] ..... G03C 7/00

[52] U.S. Cl. ..... 430/505; 430/504; 430/549; 430/551; 430/553; 430/555; 430/557; 430/558; 430/565

[58] Field of Search ..... 430/549, 551, 553, 555, 430/557, 504, 505, 372, 565, 558

[56] References Cited

U.S. PATENT DOCUMENTS

| | | | |
|---|---|---|---|
| 2,360,290 | 10/1944 | Vittum et al. | 430/372 |
| 3,408,194 | 10/1968 | Loria | 430/548 |
| 3,580,722 | 5/1971 | Sakamoto et al. | 430/549 |
| 3,647,452 | 3/1972 | Hendess et al. | 430/384 |
| 3,933,501 | 1/1976 | Cameron et al. | 430/504 |
| 4,128,427 | 12/1978 | Monbaliu et al. | 430/548 |
| 4,130,427 | 12/1978 | Monbaliu et al. | 430/389 |
| 4,420,556 | 12/1983 | Booms et al. | 430/549 |

OTHER PUBLICATIONS

Research Disclosure, Item 17643, Dec. 1978.

*Primary Examiner*—J. Travis Brown

*Attorney, Agent, or Firm*—Sughrue, Mion, Zinn, Macpeak, and Seas

[57] ABSTRACT

In a silver halide color photographic material is disclosed. The material is comprised of a blue-sensitive silver halide emulsion layer, a green-sensitive silver halide emulsion layer, and a red-sensitive silver halide emulsion layer. The granularity of the material is improved by incorporating a non-diffusible coupler capable of forming a properly smearing diffusible dye by causing a reaction with the oxidation product of a color developing agent and a colorless competing compound capable of capturing the oxidation product of a color developing agent in at least one of the foregoing silver halide emulsion layers.

10 Claims, 3 Drawing Figures

SILVER HALIDE COLOR PHOTOGRAPHIC MATERIALS WITH DIFFUSIBLE DYE FOR IMPROVING GRAININESS

FIELD OF THE INVENTION

This invention relates to silver halide color photographic materials and more particularly to silver halide color photographic material having improved graininess.

BACKGROUND OF THE INVENTION

Recently, there has been increasing popularity of 110 size cameras. The photographic enlargement prints obtained from the small 110 picture image does not have the same graininess and resolving power as those of a print obtained by enlarging from a large-sized picture image.

The graininess of a color image can be improved by increasing the number of silver halide grains and diffusing dyes formed by color development as described in T. H. James, "Theory of the Photographic Process", 4th Edition, pages 620–621. However, attempts at increasing the number of silver halide grains while maintaining a high photographic sensitivity requires an increase in the amount of coated silver and causes a reduction in resolving power due to the increased amount of silver as well as other disadvantages relating to cost and other photographic properties.

Attempts at improving graininess by diffusion of dyes improves the rms (root mean square) granularity by using so-called dye diffusible type couplers as described in British Pat. No. 2,080,640A but this method gives an unpleasant visual sensation as described later.

The inventors have made various investigations with respect to improving graininess and have found the following. When a non-diffusible type coupler forms a properly smearing diffusible coupler (hereinafter, the non-diffusible type coupler is referred to as a dye diffusible type coupler), the so-called rms granularity (the rms granularity is described in T. H. James; "Theory of the Photographic Process"; 4th Edition, page 619) is greatly improved. However, the positioning and development probability of silver halide particles occur in random course, the dye diffuses to smear and mixes with the neighboring dye or dyes, whereby the overlap of dye clouds becomes larger thus randomly forming huge dye clouds. This is visually very unpleasant and the visual sensation of graininess is sometimes deteriorated.

SUMMARY OF THE INVENTION

Therefore, as the results of various investigations on improving the visual sensation of graininess, the inventors have discovered that by using a dye diffusible type coupler together with a substantially colorless competing compound which captures the oxidation product of a color developing agent, the foregoing unpleasant visual sensation is eliminated and a color photographic material having excellent visual graininess and rms granularity can be provided.

That is, according to this invention, there is provided a silver halide photographic material having a blue-sensitive silver halide emulsion layer, a green-sensitive emulsion layer, and a red-sensitive layer wherein at least one layer of the silver halide emulsion layers contains a non-diffusible coupler which forms a properly smearing diffusible dye upon reaction with the oxidation product of a color developing agent together with a substantially colorless competing compound which captures the oxidation product of a color developing agent.

DETAILED DESCRIPTION OF THE INVENTION

Figure 1:
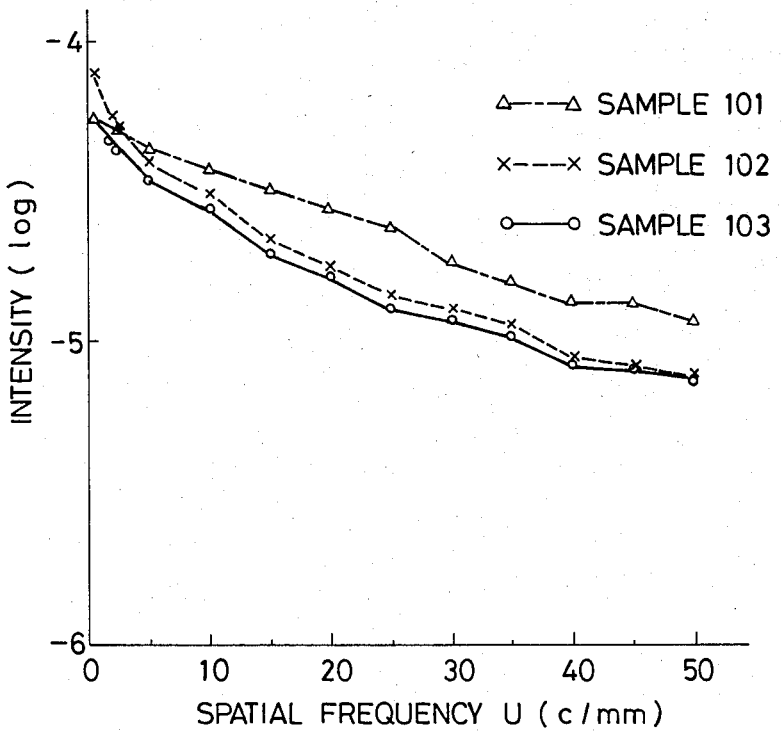
FIG. 1 is a graph showing the Wiener spectra of magenta images of samples 101, 102, and 103 at the density $D_{min}+0.2$.
Figure 2:
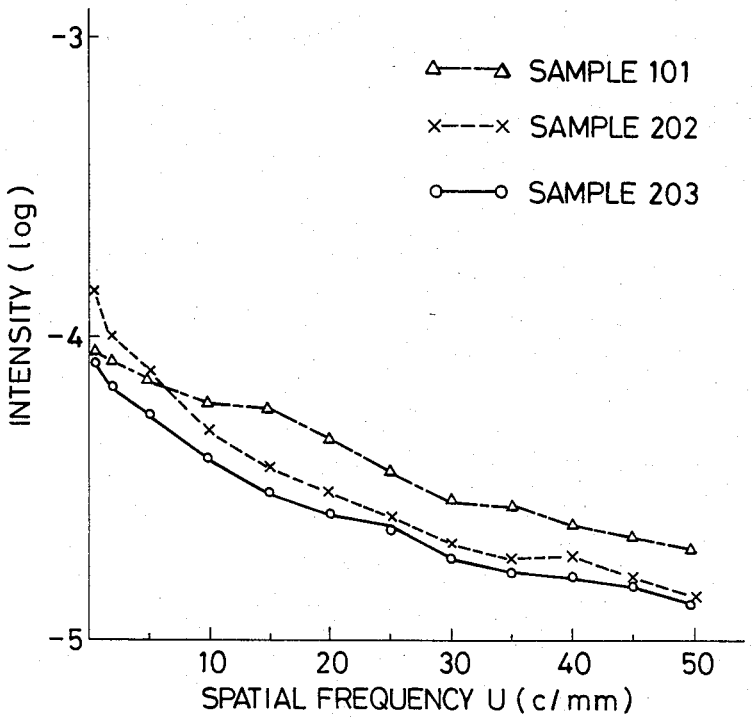
FIG. 2 is a graph showing the Wiener spectra of cyan images of samples 101, 202, and 203 at the density $D_{min}+0.2$.

When a dye diffusible type coupler is used, equal amounts of dye diffuse into the periphery of each dye cloud creating a dye cloud having a small distribution of density and a large area (hereinafter referred to as a diffusion type dye cloud). The granularity of an image obtained using such a dye is expressed by the so-called rms value, and an improved value is obtained. However, since the dye clouds become larger as described above, the dye clouds overlap each other. Therefore, when the granularity is expressed by the so-called Wiener spectrum (see, T. H. James; "The Theory of Photographic Process", 4th Edition, page 621), the value of expressing the granularity at a low frequency portion thereof becomes rather higher when using the dye diffusible type coupler (the lower the value is, the better the granularity is). For example, in FIG. 1 of the accompanying drawing, at the portion where space frequency U is less than 3, the curve for sample 102 is disposed above the curve for sample 101. This means that in visual sensation large mottles composed of several dye clouds are seen. Actually, the use of a dye diffusible type coupler gives a very unpleasant visual sensation and gives the appearance that the graininess is bad whereas the value of the granularity expressed by the rms value becomes better.

When a compound (competing compound) capturing the oxidation product of a color developing agent exists in such a system, the foregoing diffusible type dye clouds become smaller while keeping the same shape. This results in reducing the overlap of the dye clouds with each other to reduce the value of the Wiener spectrum at the low frequency portion. In other words, by the existence of the competing compound, large mottles are not visualized, whereby the visual sensation of graininess is improved.

A compound (competing compound) capturing the oxidation product of a color developing agent is generally classified into two groups by the difference in reaction system as will be explained below. The use of a competing compound the reaction of which is an oxidized color developing agent proceeds in an oxidation reduction reaction is advantageous since the rate of the capture reaction for the oxidized product of a color developing agent and hence the addition amount thereof may be less.

As described above, in this invention the visual graininess of a silver halide color photographic material is greatly improved by using the dye diffusible type coupler and the competing compound.

The dye diffusible type couplers used in this invention include the compounds shown by following general formula 1

$$(Cp\rightarrow X_a \qquad 1$$

wherein Cp represents a diffusible coupler moiety which improves the granularity by causing proper smearing of the dye image; X represents a group which is bonded to the coupling position of the coupler moiety and is released by the reaction with the oxidation product of a color developing agent; said group being a moiety having a ballast group of 8–32 carbon atoms; and a represents 1 or 2.

The addition amount of the dye diffusible type coupler is 0.005 mole to 0.2 mole, preferably 0.01 mole to 0.05 mole per mole of silver.

The amount of the competing compound is 1 mole% to 300 mole%, preferably 5 mole% to 100 mole% of the dye diffusible type coupler.

In the couplers shown by general formula 1 the couplers shown by following general formulae (I) and (II) are preferred.

(I)

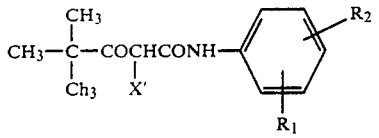

(II)

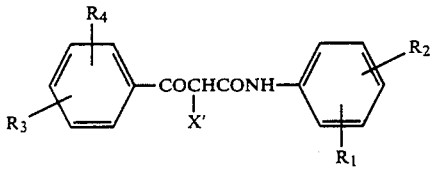

wherein $R_1$, $R_2$, $R_3$ and $R_4$, which may be the same or different, each represents a hydrogen atom, a halogen atom, an alkyl group (e.g., methyl group, ethyl group, isopropyl group, hydroxyethyl group, etc.), an alkoxy group (e.g., methoxy group, ethoxy group, methoxyethoxy group, etc.), an aryloxy group (e.g., phenoxy group, etc.), an acylamino group (e.g., acetylamino group, trifluoroacetylamino group, etc.), a sulfonamino group (e.g., methanesulfonamino group, benzenesulfonamino group, etc.), a carbamoyl group, a sulfamoyl group, an alkylthio group, an alkylsulfonyl group, an alkoxycarbonyl group, a ureido group, a cyano group, a carboxy group, a hydroxy group, or a sulfo group; the total carbon number of $R_1$, $R_2$, $R_3$ and $R_4$ being, however, not over 10, and X' represents a group which has a so-called ballast group of 8 to 32 carbon atoms rendering the coupler non-diffusible and can be released by coupling with the oxidation product of an aromatic primary amino color developing agent. More particularly, X' can be shown by the following general formula (III) or (IV)

(III) (IV)

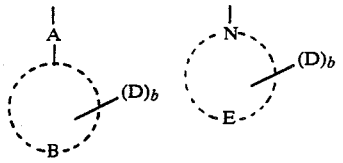

wherein A represents an oxygen atom or a sulfur atom; B represents a non-metallic atomic group necessary for forming an aryl ring or a heterocyclic ring; E represents a non-metallic atomic group necessary for forming a 5-membered or 6-membered heterocyclic ring together with a nitrogen atom; each of these rings may be further condensed with an aryl ring or a heterocyclic ring; D represents a ballast group; and b represents a positive integer; when b is a plural number, Ds may be the same or different and the total carbon number thereof is 8 to 32; said D may have a bonding group such as —O—, —S—, —COO—, —CONH—, —$SO_2$NH—, —NHCONH—, —$SO_2$—, —CO—, —NH—, etc.

Other examples of the couplers shown by general formula 1 are the couplers shown by following general formulae (V), (VI) and (VII).

(V) (VI)

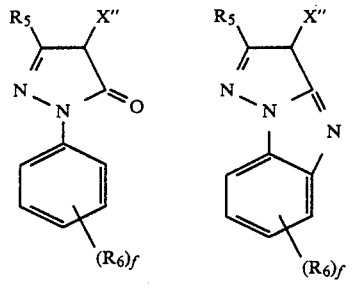

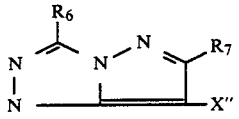

wherein $R_5$ represents an acylamino group (e.g., propane-amido group, benzamido group, etc.), an anilino group (e.g., 2-chloroanilino group, 5-acetamidoanilino group, etc.), or a ureido group (e.g., a phenylureido group, butaneureido group, etc.); $R_6$ and $R_7$ each represents a halogen atom, an alkyl group (e.g., methyl group, ethyl group, etc.), an alkoxy group (e.g., methoxy group, ethoxy group, etc.), an acylamino group (e.g., acetamido group, benzamido group, etc.), an alkoxycarbonyl group (e.g., methoxycarbonyl group, etc.), an N-alkylcarbamoyl group (e.g., N-methylcarbamoyl group, etc.), a ureido group (e.g., N-methylureido group, etc.), a cyano group, an aryl group (e.g., phenyl group, naphthyl group, etc.), an N,N-dialkylsulfamoyl group, a nitro group, a hydroxy group, a carboxy group, or an aryloxy group; f is an integer of 0 to 4; when f is 2 to 4, said $R_6$s may be the same or different; the total carbon number of $R_5$ and $(R_6)_f$ in general formulae (V) and (VI) and the total carbon number of $R_6$ and $R_7$ in general formula VII is not over 10; and X'' represents a group shown by following general formula (VIII), (IX) or (X):

(VIII) (IX) (X)

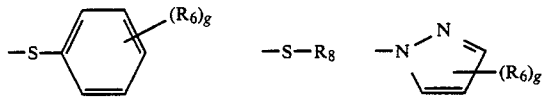

wherein $R_6$ is a group selected from the groups illustrated in regard to $R_6$ of general formula (V) to (VII), when g is 2 or more, said $R_6$s may be the same or different and the total carbon number of $(R_6)_g$ is 8–32.

$R_8$ represents an alkyl group (e.g., butyl group, dodecyl group, etc.), an aralkyl group (e.g., benzyl group, etc.), an alkenyl group (e.g., allyl group, etc.), or a cyclic alkyl group (e.g., cyclopentyl group, etc.), the foregoing groups may be substituted by a halogen atom, an alkoxy group (e.g., butoxy group, dodecyloxy group, etc.), an acylamino group (e.g., acetamido group, tetradecanamido group, etc.), an alkoxycarbonyl group (e.g., tetradecyloxycarbonyl group, etc.), an N-alkylcarbamoyl group (e.g., N-dodecylcarbamoyl group, etc.), a ureido group (e.g., tetradecylureido group, etc.), a cyano group, an alkylthio group (e.g., dodecylthio group, etc.), an alkylsulfinyl group (e.g., tetradecylsulfinyl group, etc.), an alkylsulfone group, an anilino group, a sulfonamido group (e.g., hexadecanesulfonamido group, etc.), an N-alkylsulfamoyl group, an aryloxy group, or an acyl group (e.g., tetradecanoyl group, etc.); the total carbon number of $R_8$ being 8–32.

Still other preferred examples of the couplers shown by general formula 1 are the couplers shown by following general formulae (XI) and (XII)

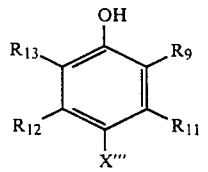

(XI)

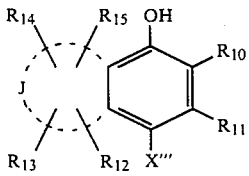

(XII)

wherein $R_9$ represents a hydrogen atom, an aliphatic group having 10 or less carbon atoms (e.g., alkyl groups such as methyl group, isopropyl group, acyl group, cyclohexyl group, octyl group, etc.), an alkoxy group having 10 or less carbon atoms (e.g., methoxy group, isopropoxy group, pentadecyloxy group, etc.), an aryloxy grup (e.g., phenoxy group, p-tert-butylphenoxy group, etc.), the acylamido group shown by following formula (XIII), the sulfonamido group shown by following formula (XIV), the ureido group shown by following formula (XV), or the carbamoyl group shown by following formula (XVI)

$$-NH-CO-G \quad (XIII)$$

$$-NH-SO_2-G \quad (XIV)$$

-continued $$-NHCONH-G \quad (XV)$$

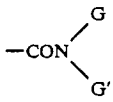

(XVI)

wherein G and G', which may be the same or different and the total carbon number of G and G' is 1–12 in formula (XVI), each represents a hydrogen atom (excluding the case that G and G' in formula (XVI) are hydrogen atom), an aliphatic group of 1–12 carbon atoms, preferably a straight chain or branched alkyl group having 4–10 carbon atoms or a cyclic alkyl group (e.g., cyclopropyl group, cyclohexyl group, norbornyl group, etc.), or an aryl group (e.g., phenyl group, naphthyl group, etc.). The foregoing alkyl group and aryl group may be substituted by a halogen atom (e.g., fluorine, chlorine, etc.), a nitro group, a cyano group, a hydroxyl group, a carboxy group, an amino group (e.g., amino group, alkylamino group, dialkylamino group, anilino group, N-alkylanilino group, etc.), an alkyl group (e.g., the alkyl groups as described above), an aryl group (e.g., phenyl group, acetylaminophenyl group, etc.), an alkoxycarbonyl group (e.g., butyloxycarbonyl group, etc.), an acyloxycarbonyl group, an amido group (e.g., acetamido group, methanesulfonamido group, etc.), an imido group (e.g., succinic acid imido group, etc.), a carbamoyl group (e.g., N,N-diethylcarbamoyl group, etc.), a sulfamoyl group (e.g., N,N-diethylsulfamoyl group, etc.), an alkoxy group (e.g., ethoxy group, butyloxy group, octyloxy group, etc.), an aryloxy group (e.g., phenoxy group, methylphenoxy group, etc.), etc. $R_9$ may also has an ordinary substituent in addition to the foregoing substituent.

$R_{10}$ represents a hydrogen atom or an aliphatic group having 12 or less than 12 carbon atoms, in particular an alkyl group of 1–10 carbon atoms or the carbamoyl group shown by the foregoing general formula (XVI).

$R_{11}$, $R_{12}$, $R_{13}$, $R_{14}$ and $R_{15}$ each represents a hydrogen atom, a halogen atom, an alkyl group, an aryl group, an alkoxy group, an alkylthio group, a heterocyclic group, an amino group, a carboxamido group, a sulfonamido group, a sulfamyl group, or a carbamyl group. More particularly, $R_{11}$, $R_{12}$, $R_{13}$, $R_{14}$ and $R_{15}$ each represents a hydrogen atom, a halogen atom (e.g., chlorine atom, bromine atom, etc.), a primary, secondary, or tertiary alkyl group having 1–12 carbon atoms (e.g., methyl group, propyl group, isopropyl group, n-butyl group, sec-butyl group, tert-butyl group, hexyl group, dodecyl group, 2-chlorobutyl group, 2-hydroxyethyl group, 2-phenylethyl group, 4-(2,4,6-trichlorophenyl)ethyl group, 2-aminoethyl group, etc.), an alkylthio group (e.g., octylthio group, etc), an aryl group (e.g., phenyl group, 4-methylphenyl group, 2,4,6-trichlorophenyl group, 3,5-dibromophenyl group, 4-trifluoromethylphenyl group, 2-trifluoromethylphenyl group, 3-trifluoromethylphenyl group, naphthyl group, 2-chloronaphthyl group, 3-ethylnaphthyl group, etc.), a heterocyclic group (e.g., benzofuranyl group, furanyl group, thiazolyl group benzothiazolyl group, naphthoxazolyl group, pyridyl group, quinolinyl group, etc.), an amino group (e.g., amino group, methylamino group, diethylamino group, dodecylamino group, phenylamino group, tolylamino group, 4-cyanophenylamino group, 2-trifluoromethylphenylamino group, benzothiazolamino group, etc.), a carboxamido group (e.g., an alkylcarboxamido group such as ethylcarboxamido group, decylcarboxamido group, etc.; an arylcarboxamido group such as phenylcarboxamido group, 2,4,6-trichlorophenylcarboxamido group, 4-methylphenylcarboxamido group, 2-ethoxyphenylcarboxamido group, naphthylcarboxamido group, etc.; a heterocyclic carboxamido group such as thiazolylcarboxamido group, benzothiazolylcarboxamido group, naphthothiazolylcarboxamido group, oxazolylcarboxamido group, benzoxazolylcarboxamido group, imidazolylcarboxamido group, benzimidazolylcarboxamido group, etc.), a sulfonamido group (e.g., an alkylsulfonamido group such as butylsulfonamido group, dodecylsulfonamido group, phenylethylsulfonamido group, etc; an arylsulfonamido group such as phenylsulfonamido group, 2,4,6-trichlorophenylsulfonamido group, 2-methoxyphenylsulfonamido group, 3-carboxyphenylsulfonamido group, naphthylsulfonamido group, etc.; a heterocyclic sulfonamido group such as thiazolylsulfonamido group, benzothiazolylsulfonamido group, imidazolylsulfonamido group, benzimidazolylsulfonamido group, pyridylsulfonamido group, etc.), a sulfamyl group (e.g., an alkylsulfamyl group such as propylsulfamyl group, octylsulfamyl group, etc.; an arylsulfamyl group such as phenylsulfamyl group, 2,4,6-trichlorophenylsulfamyl group, 2-methoxyphenylsulfamyl group, naphthylsulfamyl group, etc.; a heterocyclic sulfamyl group such as thiazolylsulfamyl group, benzothiazolylsulfamyl group, oxazolylsulfamyl group, benzimidazolylsulfamyl group, pyridylsulfamyl group, etc.), or a carbamyl group (e.g., an alkylcarbamyl group such as ethylcarbamyl group, octylcarbamyl group, etc.); an arylcarbamyl group such as phenylcarbamyl group, 2,4,6-trichlorophenylcarbamyl group, etc.; a heterocyclic carbamyl group such as thiazolylcarbamyl group, benzothiazolylcarbamyl group, oxazolylcarbamyl group, imidazolylcarbamyl group, benzimidazolylcarbamyl group, etc.).

J represents a non-metallic atomic group necessary for forming a 5-membered or 6-membered ring such as benzene ring, cyclohexene ring, cyclopentene ring, thiazole ring, oxazole ring, imidazole ring, pyridine ring, pyrrole ring, etc. Of these rings a benzene ring is most preferred.

X''' represents a group which has 8 to 32 carbon atoms, is bonded to the coupling position through —O—, —S—, or —N=N—, and is released upon coupling with the oxidation product of an aromatic primary amine color developing agent. Preferably, X''' represents an alkoxy group, an aryloxy group, an alkylthio group, or an arylthio group, each group having 8 to 32 carbon atoms. These groups may further have a divalent group such as —O—, —S—, —NH—, —CONH—, —COO—, —$SO_2NH$—, —SO—, —$SO_2$—, —CO—,

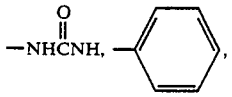

etc. It is particularly preferred that these groups have a group capable of being dissociated by an alkali, such as —COOH, —$SO_3H$, —OH, —$SO_2NH_2$. Moreover, it is possible to render the coupler substantially nondiffusible by combining $R_9$, $R_{10}$, $R_{11}$, $R_{12}$, $R_{13}$, $R_{14}$, $R_{15}$, and X'''.

Practical examples of the dye diffusible type couplers are shown below:

Y-1

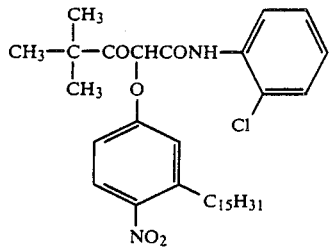

Y-2

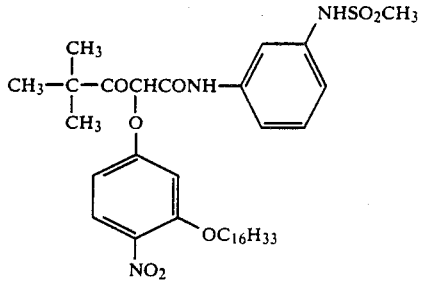

Y-3

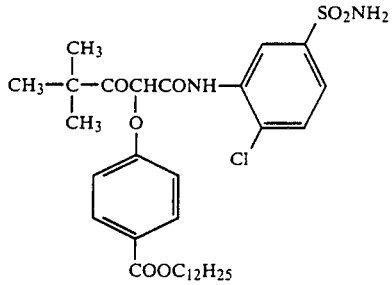

Y-4

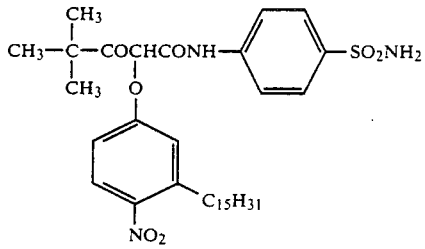

Y-5

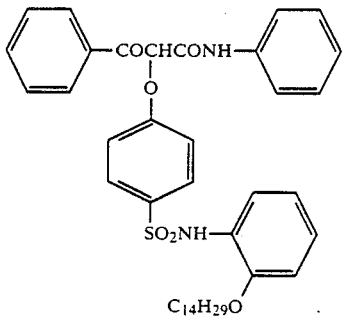

-continued
Y-6
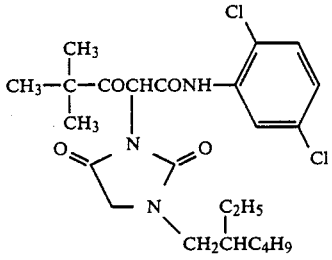
Y-7
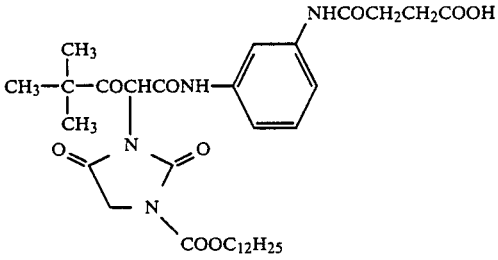
Y-8
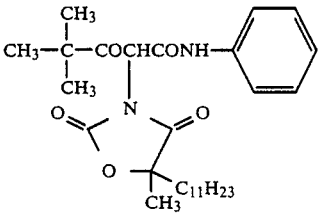
Y-9
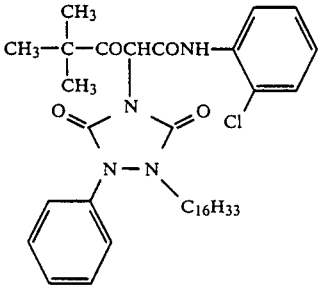
Y-10
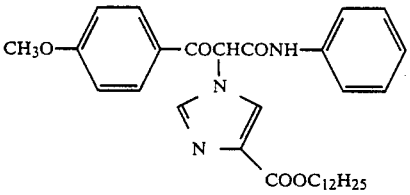
Y-11
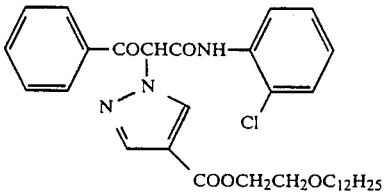
-continued
Y-12
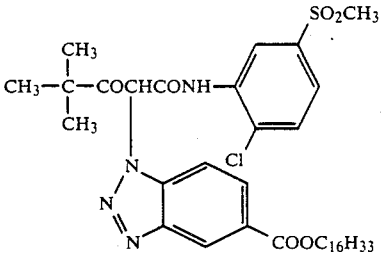
Y-13
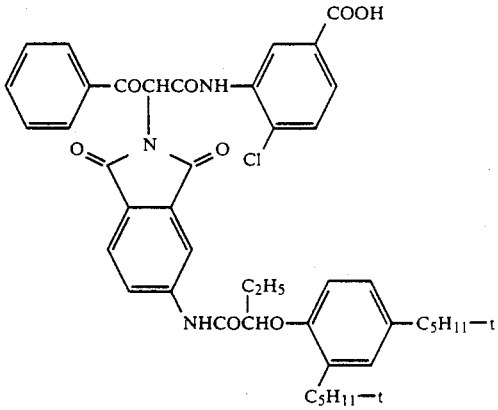
Y-14
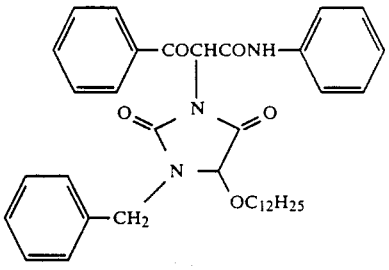
Y-15
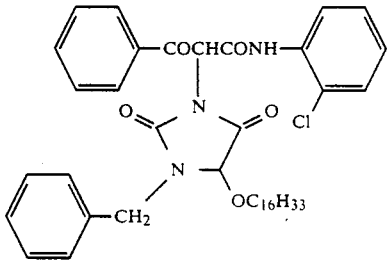
M-1
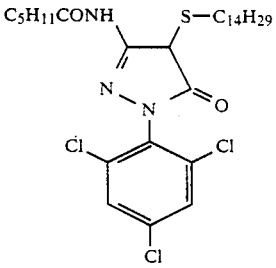

-continued
M-2
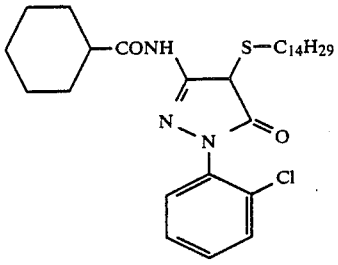
M-3
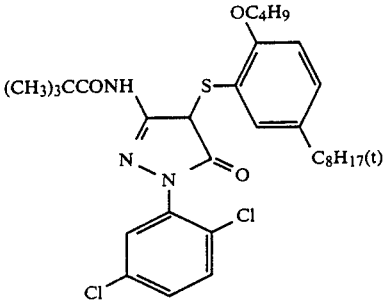
M-4
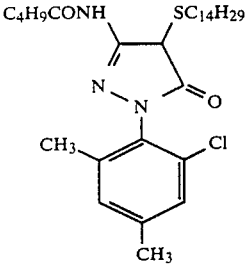
M-5
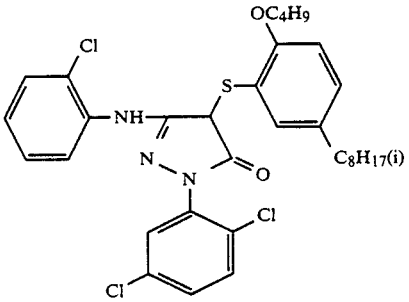
M-6
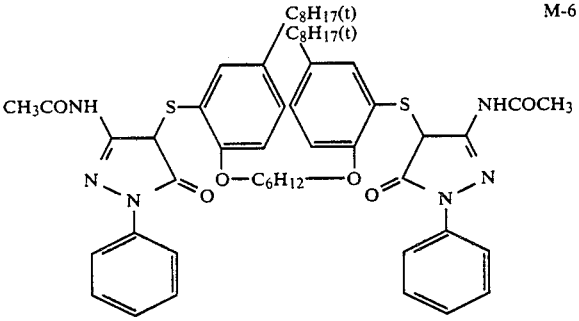
-continued
M-7
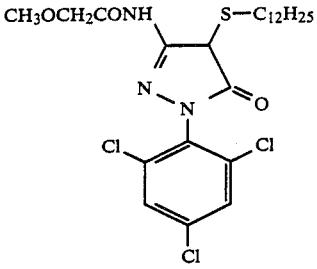
M-8
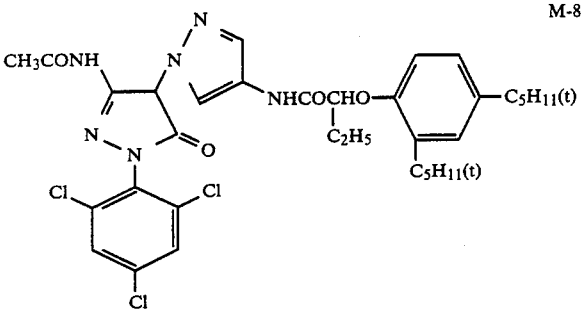
M-9
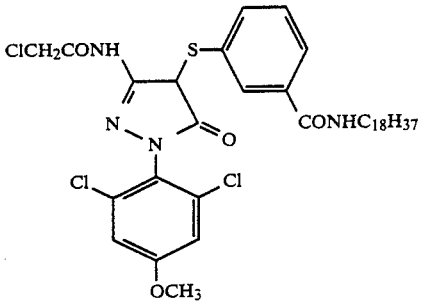
M-10
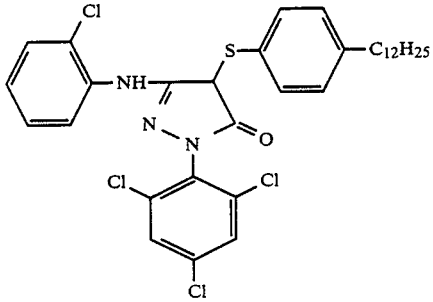
M-11
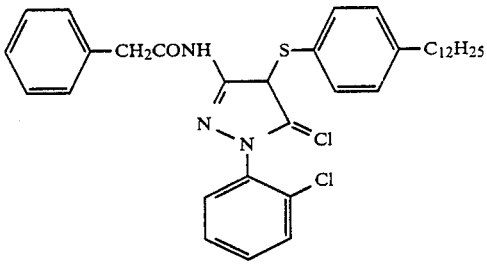

-continued
M-12
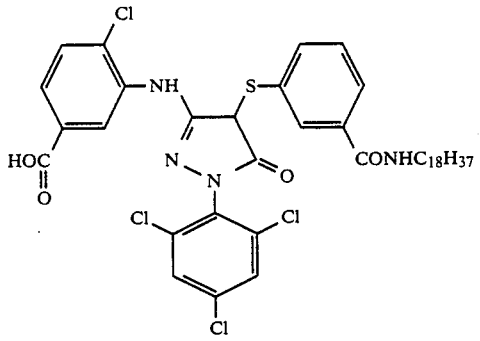
M-13
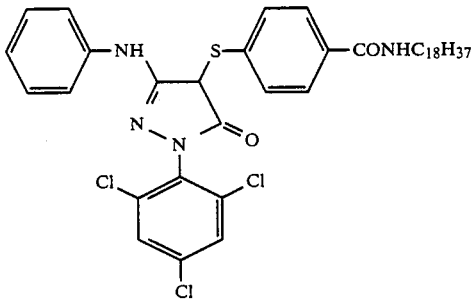
M-14
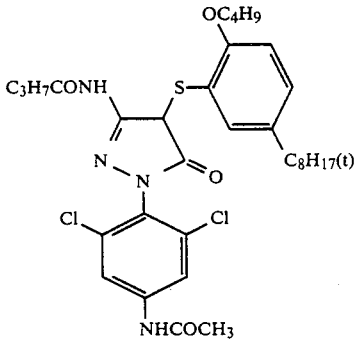
M-15
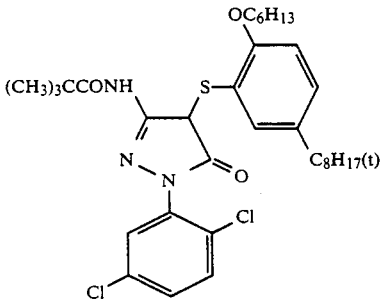
The foregoing compounds used in this invention can be prepared by the methods described in, for example, U.S. Pat. Nos. 4,264,723; 3,227,554; 4,310,619; and 4,301,235 (incorporated herein by reference to disclose methods of preparation) and Japanese Patent Application (OPI) Nos. 4044/'82; 126,833/'81; 122,935/'80, etc.
C-1
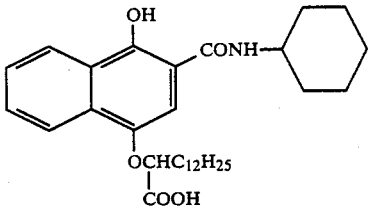
C-2
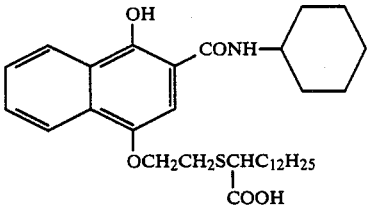
C-3
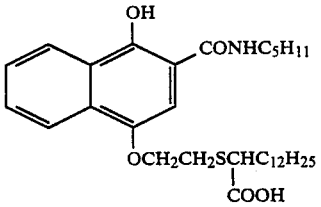
C-4
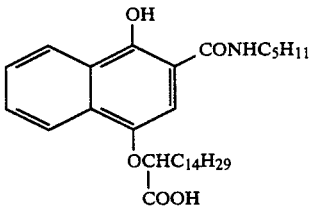
C-5
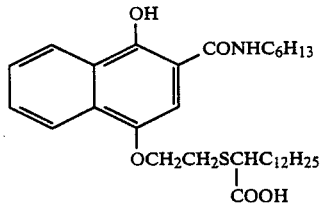
C-6
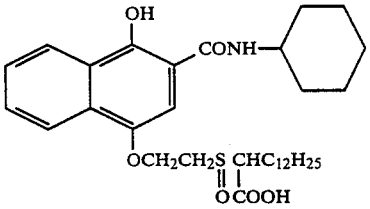
C-7
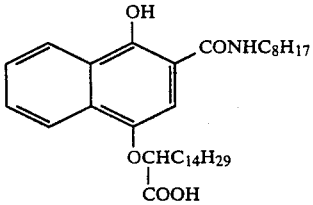

-continued

C-8

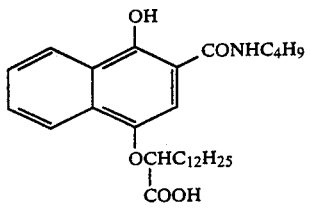

C-9

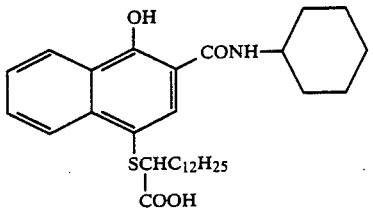

C-10

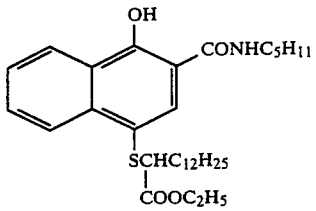

C-11

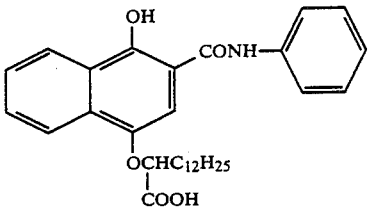

C-12

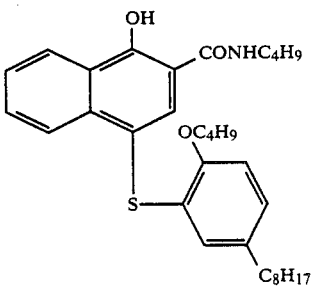

C-13

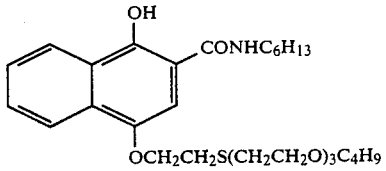

C-14

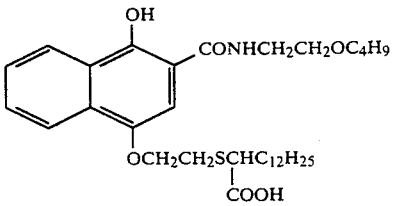

-continued

C-15

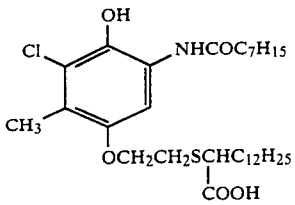

C-16

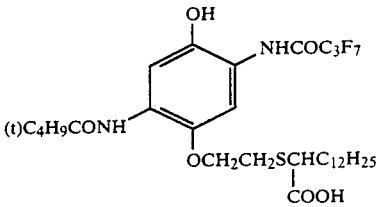

C-17

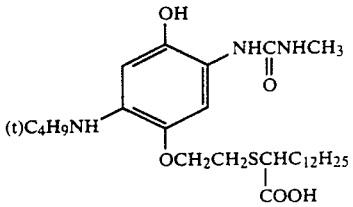

C-18

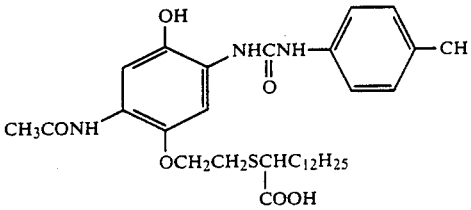

C-19

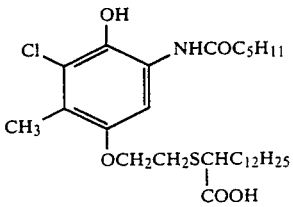

The foregoing compounds used in this invention can be easily prepared by the methods described in Japanese Patent Application (OPI) Nos. 1938/'81; 3934/'82; 105,226/'78, etc.

The competing compound in this invention is a generic name for a scavenger of oxidized color developing agents, which competitively obstructs the formation of dye by the reaction of the coupler and an oxidized color developing agent, and gives a reaction product with the oxidation product of a color developing agent. The reaction product may be colorless or may have a color to an extent of practically reducing the color balance of the color photograph formed.

The competing compound is generally classified into the following two types according to the difference in reaction system with the oxidation product of a color developing agent. That is, the 1st type is a compound generally called a reducing agent which reduces the oxidation product of a developing agent into the original developing agent and is simultaneously converted into an oxidized product. The 2nd type is a so-called non-coloring coupler which forms a new developing agent-addition product upon coupling with the oxidation product of the developing agent.

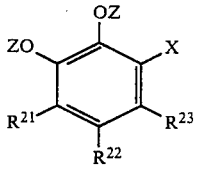
(CI)

More preferred compounds:

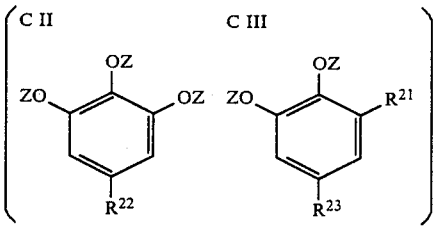

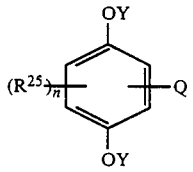
(CIV)

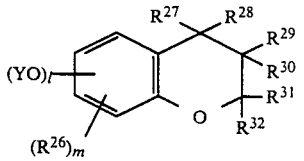
(CV)

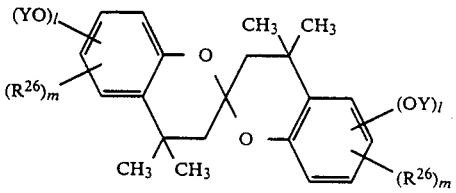
(CVI)

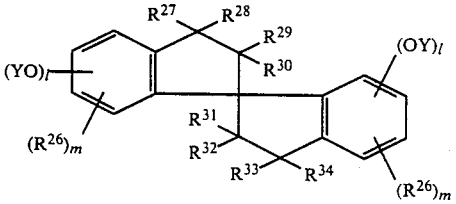
(CVII)

For obtaining a sufficient effect of improving the granularity, which is the object of this invention, the competing compound showing the reaction with the oxidized product of a developing agent at a rate as high as possible is preferred. From this meaning, the 1st type of competing compound is more preferred.

The incorporation of a reducing agent in a photographic material sometimes causes side reactions such as the deterioration of the photographic properties based on the decomposition of the compound itself by air oxidation during the preservation of the photographic material for a long period of time and the formation of fog by the direction action of the reducing agent to a silver halide emulsion. It has also been found that the reducing agents shown by following general formulae (CI) to (CVII) give less such side reactions and shows a high scavenging faculty for the oxidized product of a developing agent. (In these reducing agents, the compounds shown by general formula (CI) and (CIV) are preferred, in the compounds of (CI), the compounds shown by (CII) and (CIII) are more preferred, and further the compounds shown by general formula (CIII) are most preferred.

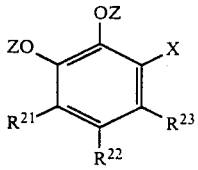
(CI)

In general formula (CI);

X represents a hydrogen atom, a substituted or unsubstituted alkyl group (e.g., methyl group, ethyl group, benzyl group, etc.), a substituted or unsubstituted alkenyl group (e.g., allyl group, butenyl group, etc.), a substituted or unsubstituted aryl group (e.g., phenyl group, 4-chlorophenyl group, p-tolyl group, etc.), or an —OZ group, wherein Z represents a hydrogen atom, an acyl group (e.g., acetyl group, propionyl group, stearoyl group, benzoyl group, etc.), an alkoxycarbonyl group (e.g., methoxycarbonyl group, ethoxycarbonyl group, phenoxycarbonyl group, etc.), a carbamoyl group (e.g., N,N-dimethylcarbamoyl group, N,N-diethylcarbamoyl group, etc.), a sulfonyl group (e.g., methanesulfonyl group, benzenesulfonyl group, etc.), an alkyl group having 1–20 carbon atoms (e.g., methyl group, ethyl group, dodecyl group, benzyl group, etc.), or an alkenyl group having 2–20 carbon atoms (e.g., allyl group, butenyl group, nethallyl group, etc.; said Zs may be the same or different.

$R^{21}$, $R^{22}$ and $R^{23}$ each represents a hydrogen atom, a halogen atom (e.g., fluorine atom, chlorine atom, bromine atom, iodine atom, etc.), a cyano group, $—SO_2R^{24}$, $—COR^{24}$, a substituted or unsubstituted alkyl group having 1 to 30 carbon atoms (e.g., methyl group, ethyl group, hexyl group, dodecyl group, pentadecyl group, octadecyl group, t-butyl group, t-octyl group, benzyl group, etc.), a substituted or unsubstituted alkenyl group having 2 to 30 carbon atoms (e.g., allyl group, butenyl group, etc.), a substituted or unsubstituted alkoxy group (e.g., methoxy group, butoxy group, hexadecyloxy group, benzyloxy group, etc.), a substituted or unsubstituted alkylthio group (e.g., methylthio group, octylthio group, hexadecylthio group, benzylthio group, etc.), or a substituted or unsubstituted aryl group (e.g., phenyl group. Also, $R^{24}$ represents a hydroxy group, a substituted or unsubstituted alkyl group having 1 to 30 carbon atoms (e.g., methyl group, octyl group, dodecyl group, hexadecyl group, octadecyl group, etc.), a substituted or unsubstituted alkoxy group (e.g., methoxy group, butyloxy group, octyloxy group, dodecyloxy group, hexadecyloxy group, octadecyloxy group, etc.), a substituted or unsubstituted aryloxy group (e.g., phenoxy group, naphthyloxy group, etc.), or a substituted or unsubstituted amino group (e.g., ethylamino group, propylamino group, dodecylamino group, hexadecylamino group, octadecylamino group, benzylamino group, anilino group, etc.).

The foregoing groups may each have a proper substituent such as, for example, an alkoxy group, an aryloxy group, a hydroxy group, an alkoxycarbonyl group, an aryloxycarbonyl group, a halogen atom, a carboxy group, a sulfo group, a cyano group, an alkyl group, an alkenyl group, an aryl group, an alkylamino group, an arylamino group, a carbamoyl group, an alkylcarbamoyl group, an arylcarbamoyl group, an acyl group, a sulfonyl group, an acyloxy group, and an acylamino group.

In the compounds of general formula (CIO the compounds shown by following general formulae (CII) and (CIII) are more preferred.

(CII)

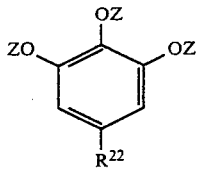

(CIII)

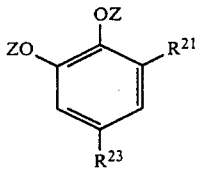

wherein Z, $R^{21}$ and $R^{23}$ are same as those shown regarding general formula (CI) but the following cases are more preferred.

That is, Z is a hydrogen atom, an acyl group, or an alkoxycarbonyl group and is more preferably a hydrogen atom. $R^{22}$ is an alkoxycarbonyl group, an N-substituted carbamoyl group, an acyl group, a sulfonyl group, a cyano group, or a halogen atom, preferably an alkoxycarbonyl group, N-substituted carbamoyl group, or an acyl group, and more preferably an alkoxycarbonyl group or an N-substituted carbamoyl group. Furthermore, $R^{22}$ is most preferably an N-substituted carbamoyl group.

$R^{21}$ and $R^{23}$ each is a hydrogen atom, a substituted or unsubstituted alkyl group, a substituted or unsubstituted aryl group, a substituted or unsubstituted alkoxy group, a substituted or unsubstituted alkylthio group, a substituted or unsubstituted acyl group, or a substituted or unsubstituted sulfonyl group and is more preferably a hydrogen atom, a substituted or unsubstituted alkyl group, a substituted or unsubstituted aryl group, or a substituted or unsubstituted alkoxy group.

Practical examples of the reducing agents used as the competing compounds in this invention are shown below but the compounds used this invention are not limited to them.

(CI-1)

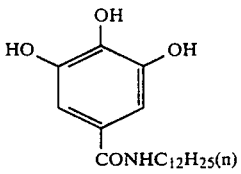

-continued (CI-2)

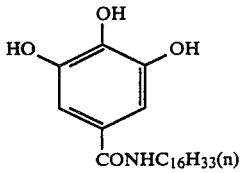

(CI-3)

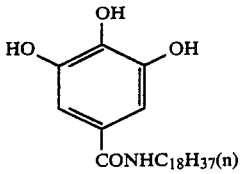

(CI-4)

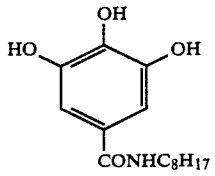

(CI-5)

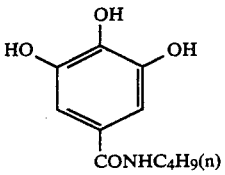

(CI-6)

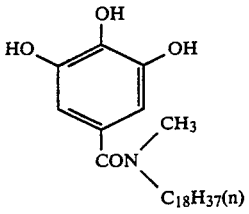

(CI-7)

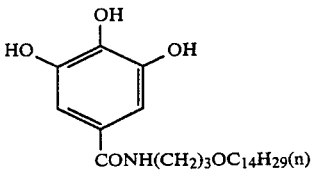

(CI-8)

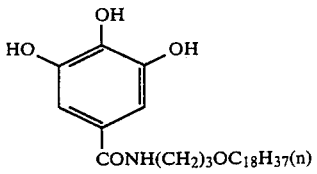

(CI-9)

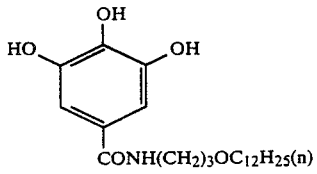

-continued
(CI-10)
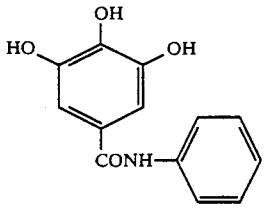
(CI-11)
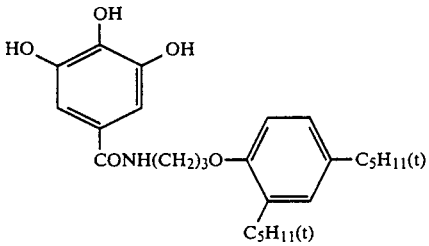
(CI-12)
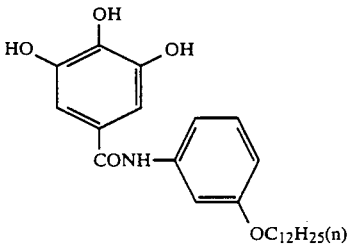
(CI-13)
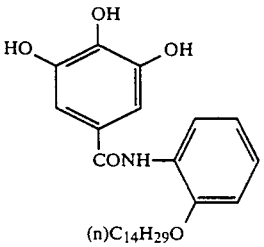
(CI-14)
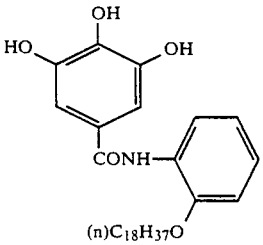
(CI-15)
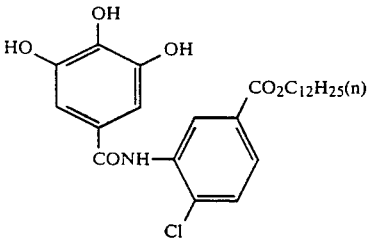
-continued
(CI-16)
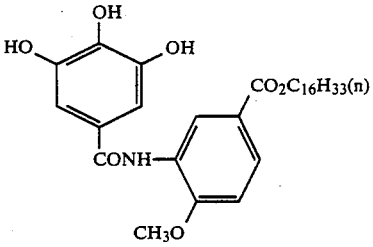
(CI-17)
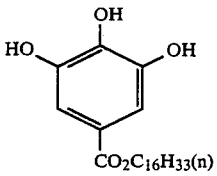
(CI-18)
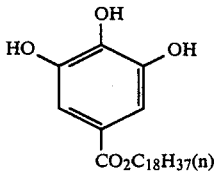
(CI-19)
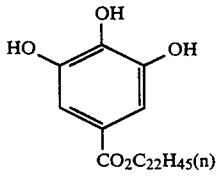
(CI-20)
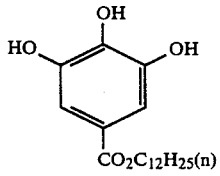
(CI-21)
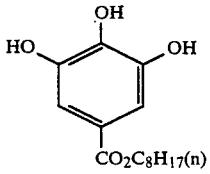
(CI-22)
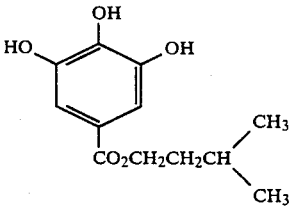
(CI-23)
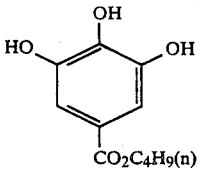

-continued
(CI-24)
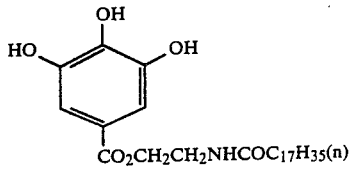
(CI-25)
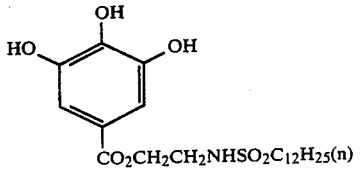
(CI-26)
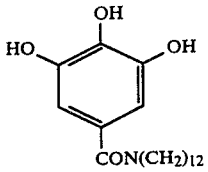
(CI-27)
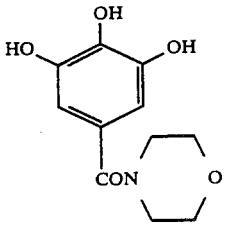
(CI-28)
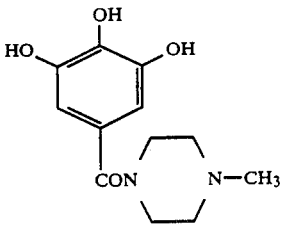
(CI-29)
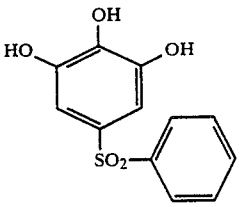
(CI-30)
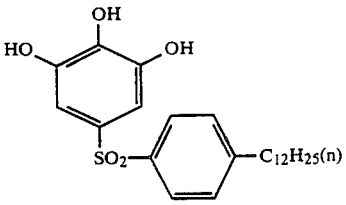
(CI-31)
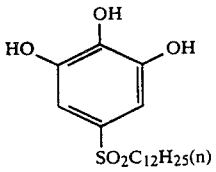
-continued
(CI-32)
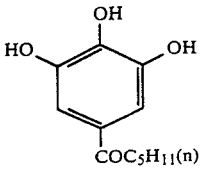
(CI-33)
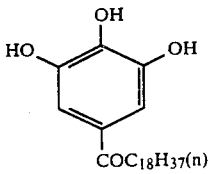
(CI-34)
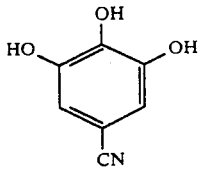
(CI-35)
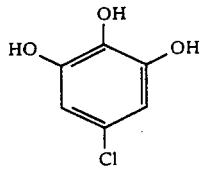
(CI-36)
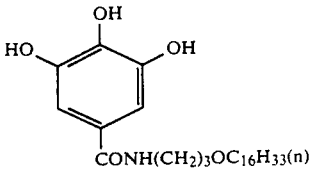
(CI-37)
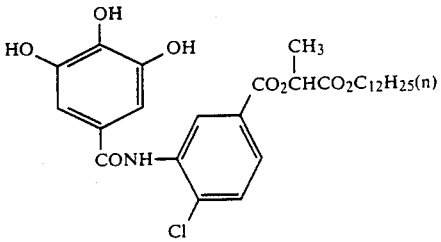
(CI-38)
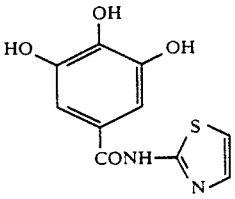
(CI-39)
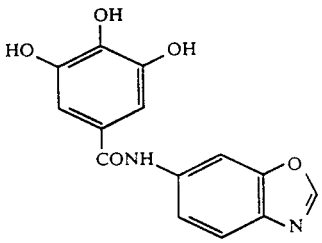

-continued
(CI-40)
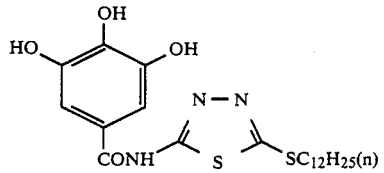
(CI-41)
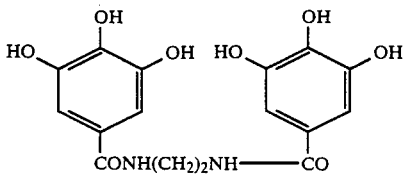
(CI-42)
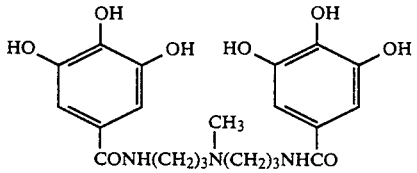
(CI-43)
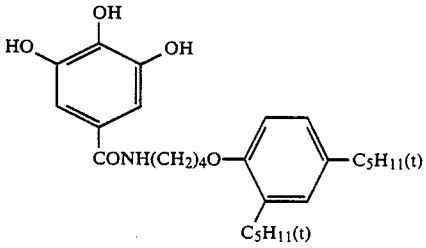
(CI-44)
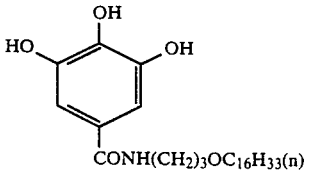
(CI-45)
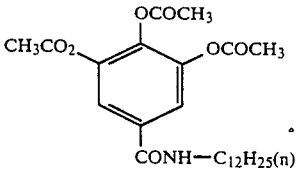
(CI-46)
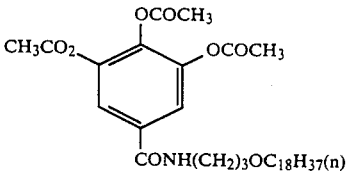
(CI-47)
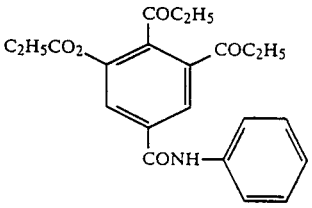
-continued
(CI-48)
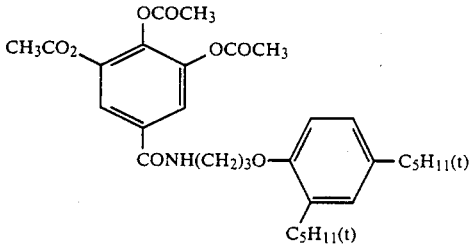
(CI-49)
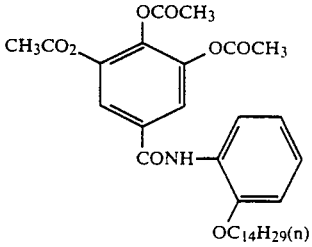
(CI-50)
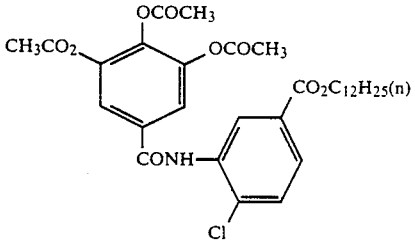
(CI-51)
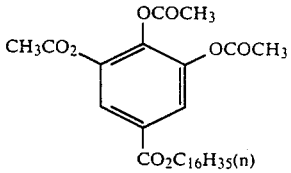
(CI-52)
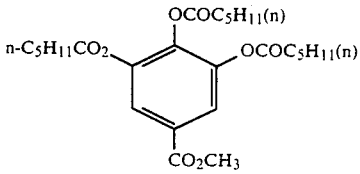
(CI-53)
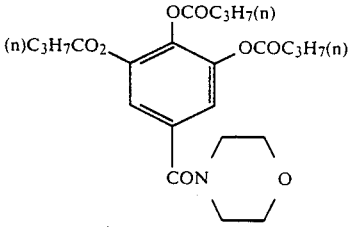
(CI-54)
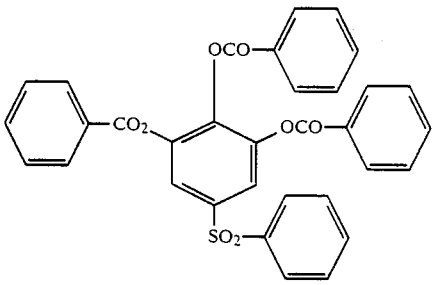

-continued
(CI-55)
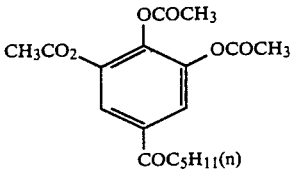
(CI-56)
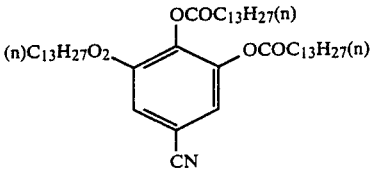
(CI-57)
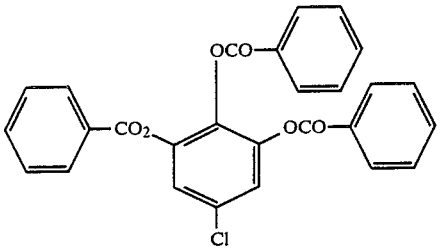
(CI-58)
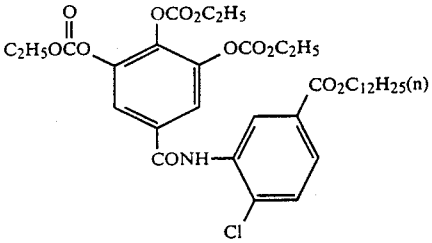
(CI-59)
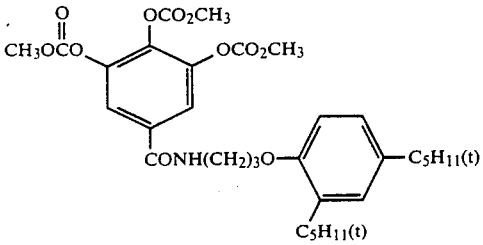
(CI-60)
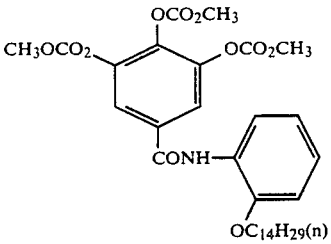
(CI-61)
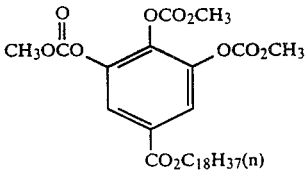
-continued
(CI-62)
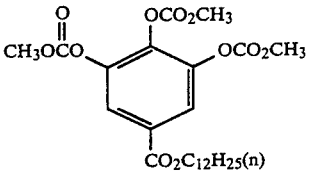
(CI-63)
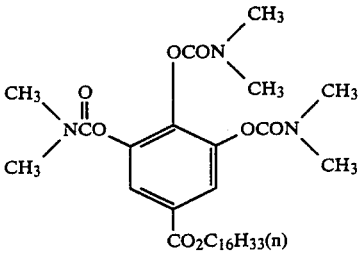
(CI-64)
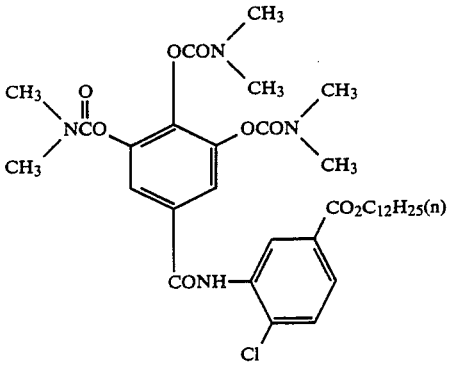
(CI-65)
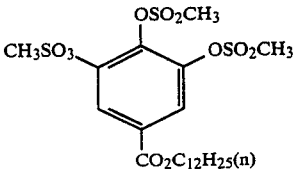
(CI-66)
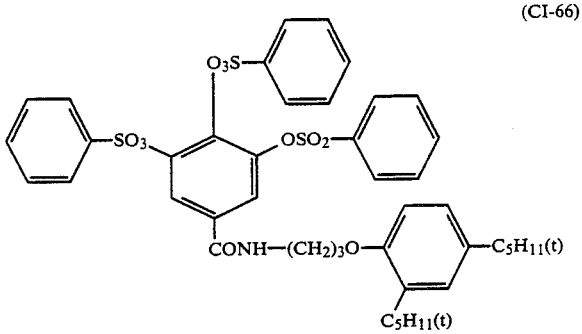
(CI-67)
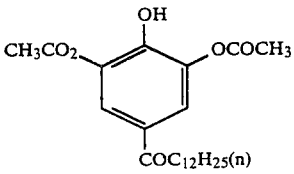

-continued
(CI-68)
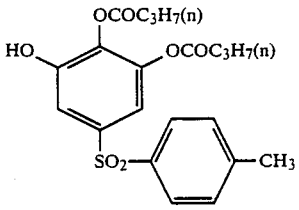
(CI-69)
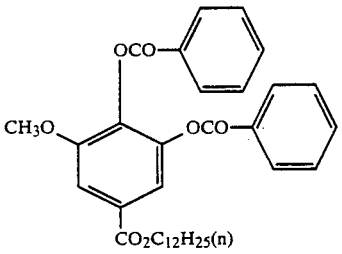
(CI-70)
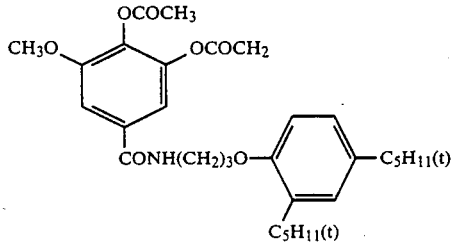
(CI-71)
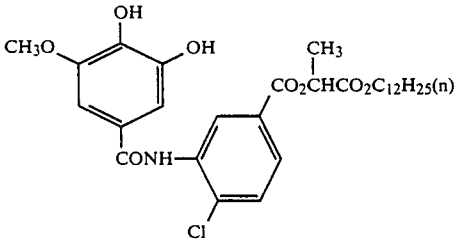
(CI-72)
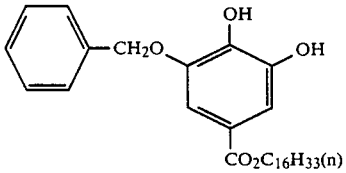
(CI-73)
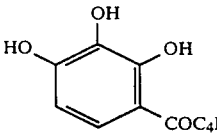
(CI-74)
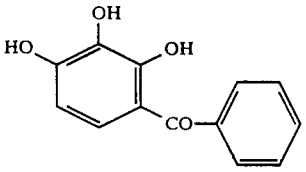
-continued
(CI-75)
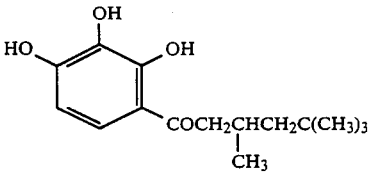
(CI-76)
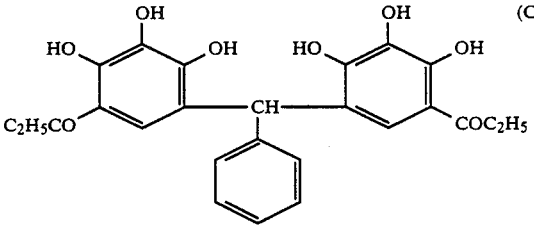
(CI-77)
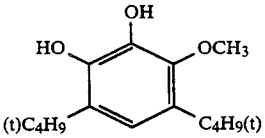
(CI-78)
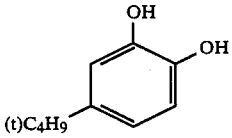
(CI-79)
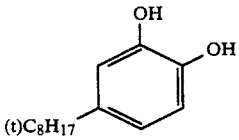
(CI-80)
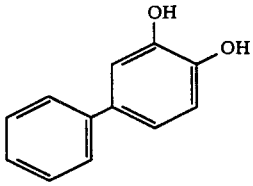
(CI-81)
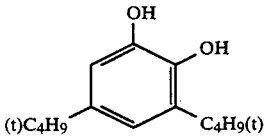
(CI-82)
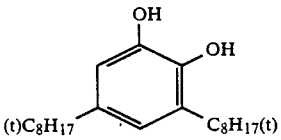
(CI-83)
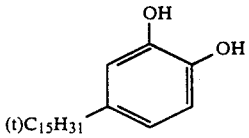
(CI-84)
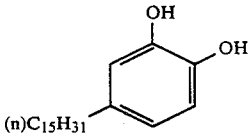

-continued
(CI-85)
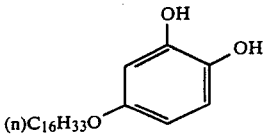
(CI-86)
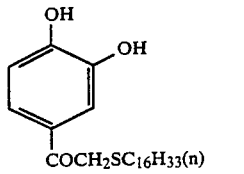
(CI-87)
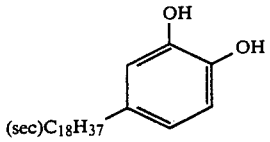
(CI-88)
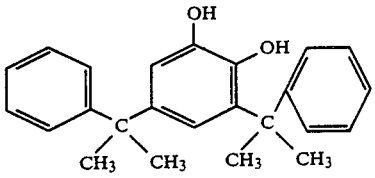
(CI-89)
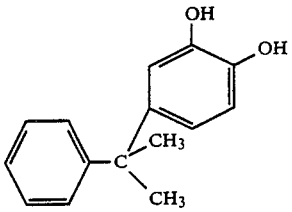
(CI-90)
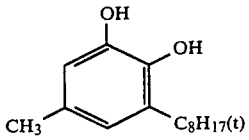
(CI-91)
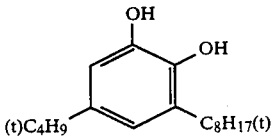
(CI-92)
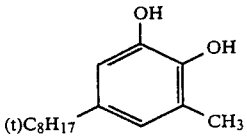
(CI-93)
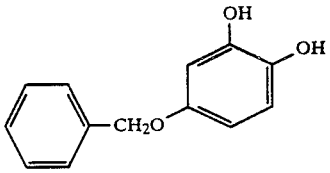
(CI-94)
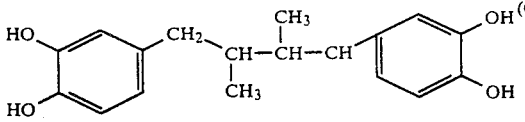
-continued
(CI-95)
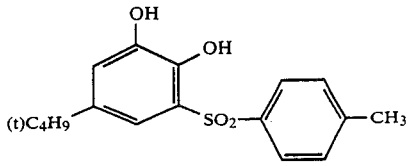
(CI-96)
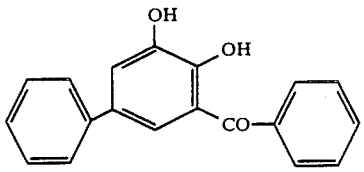
(CI-97)
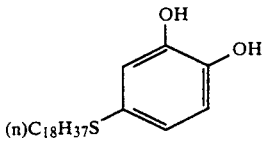
(CI-98)
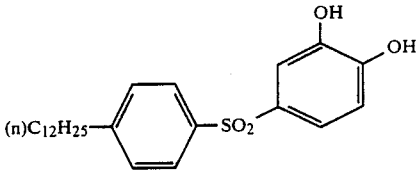
(CI-99)
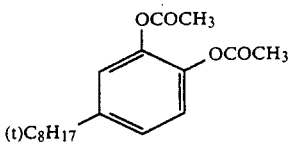
(CI-100)
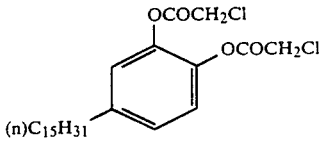
(CI-101)
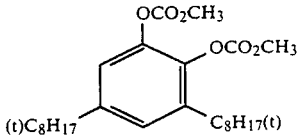
(CI-102)
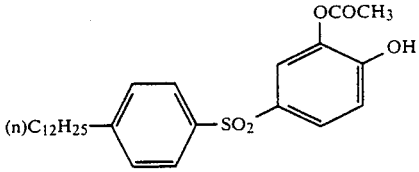
(CIV)
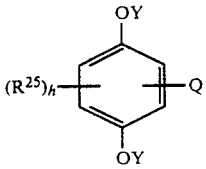
wherein $R^{25}$ represents a hydrogen atom, an alkyl group having 1–30 carbon atoms (e.g., methyl group, ethyl group, n-dodecyl group, n-hexadecyl group, n-octadecyl group, t-octyl group, sec-dodecyl group, sec-octadecyl group, n-pentadecyl group, benzyl group, etc.), an alkenyl group (e.g., allyl group, butenyl group, etc.), an aryl group (e.g., phenyl group, 4-dodecylphenyl group, etc.), an alkoxy group (e.g., methoxy group, benzyloxy group, dodecyloxy group, etc.), an aryloxy group (e.g., phenoxy group, etc.), an alkylthio group (e.g., methylthio group, octylthio group, dodecylthio group, octadecylthio group, benzylthio group, etc.), or an arylthio group (e.g., phenylthio group, etc.);

h represents an integer of 0 to 2 and when h is 2, said two $R^{25}$s may be the same or different or may form a ring by the groups;

Q represents a sulfonyl group (e.g., methanesulfonyl group, dodecanesulfonyl group, benzenesulfonyl group, p-toluenesulfonyl group, p-dodecylbenzenesulfonyl group, etc.), an acyl group (e.g., acetyl group, stearoyl group, benzoyl group, etc.), a carboxy group, an alkoxycarbonyl group (e.g., methoxycarbonyl group, octadecylcarbonyl group, etc.), a carbamoyl group (e.g., N-butylcarbamoyl group, N-dodecylcarbamoyl group, N-octadecyl-N-methylcarbamoyl group, N-phenylcarbamoyl group, etc.), a sulfamoyl group (e.g., methylsulfamoyl group, dodecylsulfamoyl group, phenylsulfamoyl group, etc.), a sulfinyl group (e.g., methylsulfinyl group, phenylsulfinyl group, dodecylsulfinyl group, etc.), or a cyano group; and Y represents a hydrogen atom, an acyl group (e.g., acetyl group, stearoyl group, benzyl group, chloroacetyl group, etc.), an alkoxycarbonyl group (e.g., methoxycarbonyl group, ethoxycarbonyl group, phenoxycarbonyl group, etc.), a carbamoyl group (e.g., N,N-dimethylcarbamoyl group, N,N-diethylcarbamoyl group, etc.), or a sulfonyl group (e.g., methanesulfonyl group, benzenesulfonyl group, etc.).

Each of the foregoing groups may have a proper substituent such as those described regarding general formula 1.

Practical examples of the compound shown by general formula (CIV) are as follows:

(CIV-1)

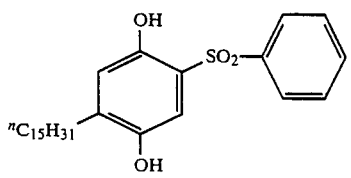

(CIV-2)

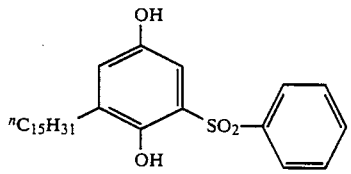

(CIV-3)

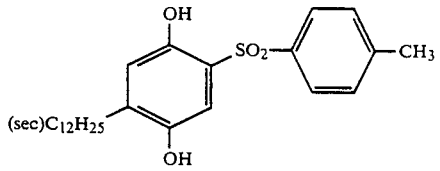

(CIV-4)

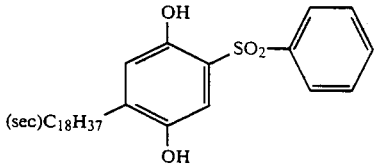

-continued (CIV-5)

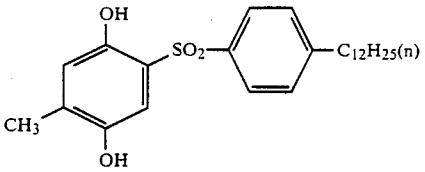

(CIV-6)

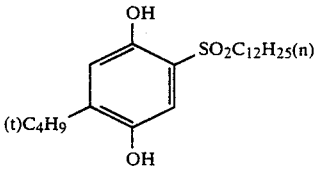

(CIV-7)

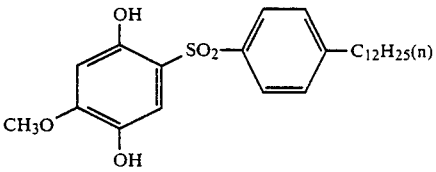

(CIV-8)

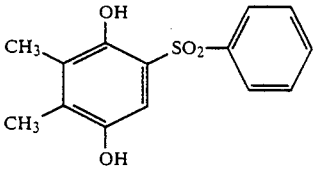

(CIV-9)

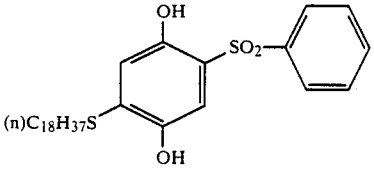

(CIV-10)

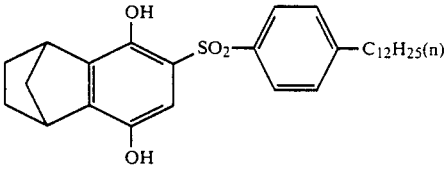

(CIV-11)

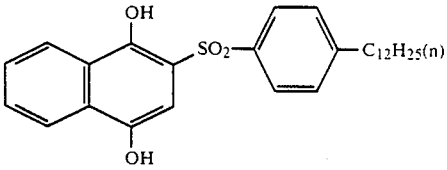

(CIV-12)

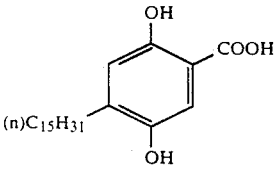

-continued (CIV-13)

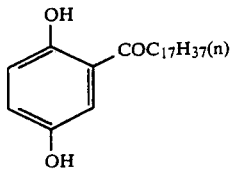

(CIV-14)

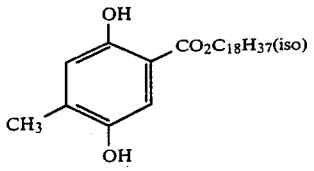

(CIV-15)

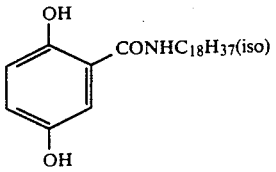

(CIV-16)

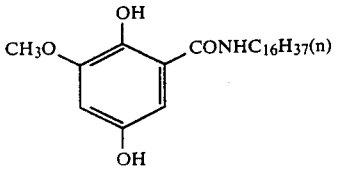

(CIV-17)

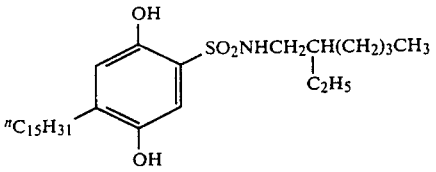

(CIV-18)

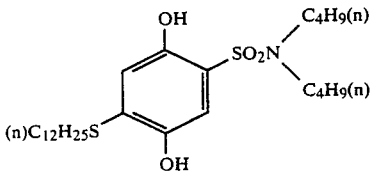

(CIV-19)

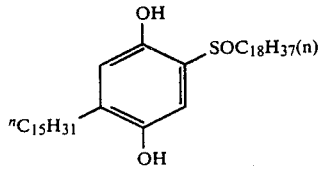

(CIV-20)

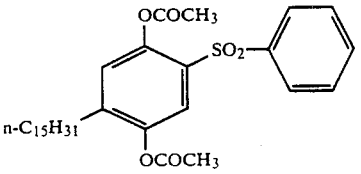

(CIV-21)

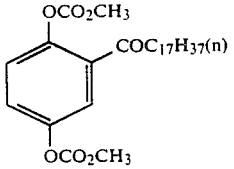

-continued (CIV-22)

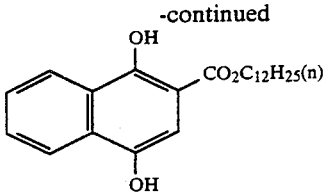

(CIV-23)

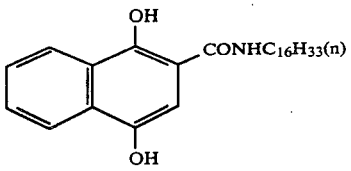

(CIV-24)

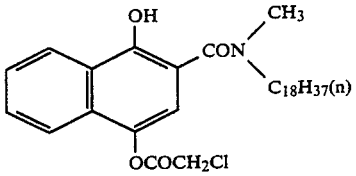

(CV)

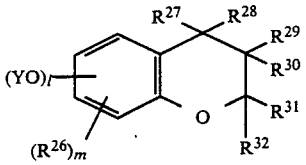

(CVI)

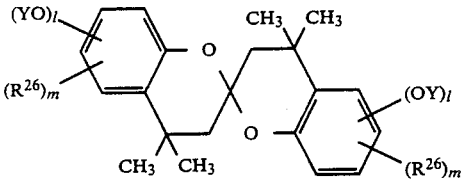

(CVII)

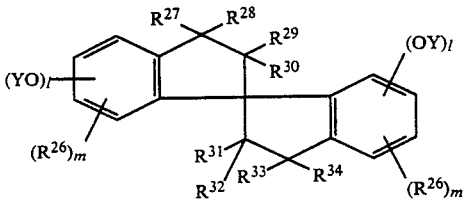

In general formulae (CV) to (CVII), $R^{26}$ represents a hydrogen atom, a halogen atom (e.g., fluorine atom, chlorine atom, bromine atom, iodine atom, etc.), a substituted or unsubstituted alkyl group having 1 to 20 carbon atoms (e.g., methyl group, ethyl group, benzyl group, etc.), a substituted or unsubstituted aryl group (e.g., phenyl group, etc.), or a substituted or unsubstituted alkoxy group (e.g., methoxy group, ethoxy group, benzyloxy group, etc.);

$R^{27}$ to $R^{34}$, which may be the same or different, each represents a hydrogen atom or a substituted or unsubstituted alkyl group having 1 to 20 carbon atoms (e.g., methyl group, ethyl group, dodecyl group, octadecyl group, etc.);

Y represents the same groups regarding general formula (CIV); and l represents an integer of 2 or 3 and m represents an integer of 0 to 2.

Each of the foregoing groups may have a proper substituent such as those described in connection with the substituents in general formula (CI).

Practical examples of the compounds shown by foregoing general formulae (CV), (CVI), and (CVII) are illustrated below.
(CV-1)
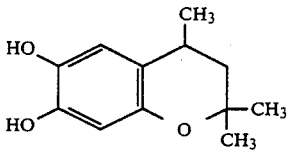
(CV-2)
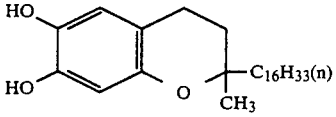
(CV-3)
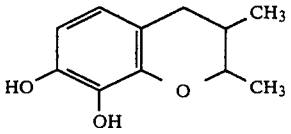
(CV-4)
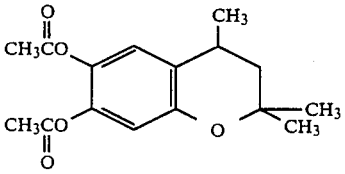
(CV-5)
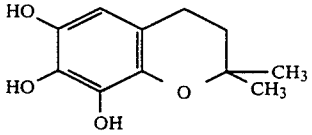
(CVI-1)
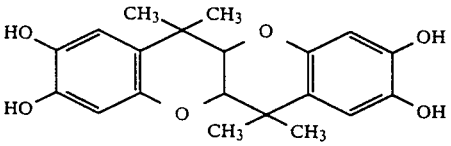
(CVI-2)
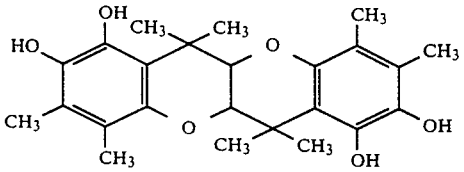
(CVI-3)
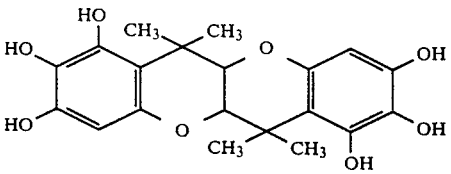
(CVI-4)
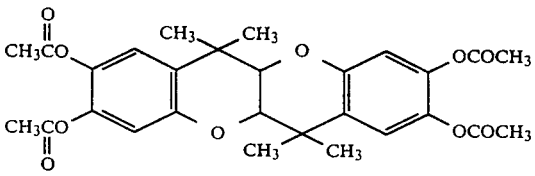
-continued
(CVI-5)
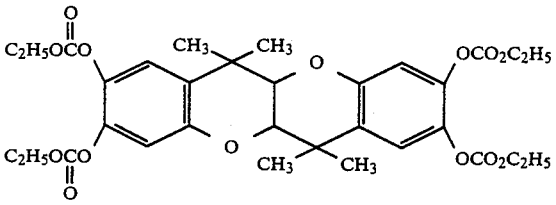
(CVII-1)
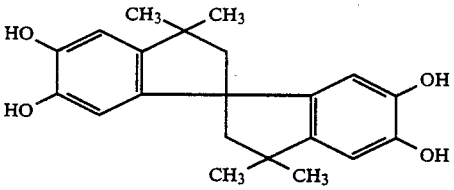
(CVII-2)
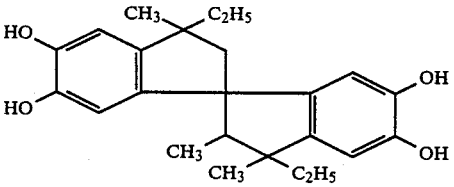
(CVII-3)
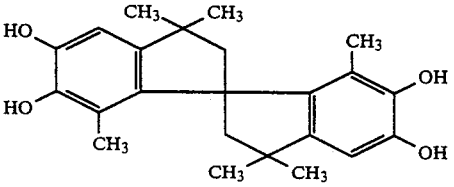
(CVII-4)
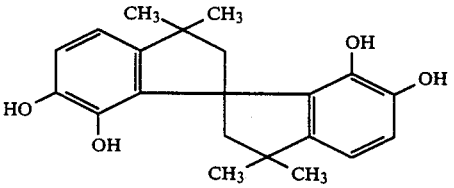
(CVII-5)
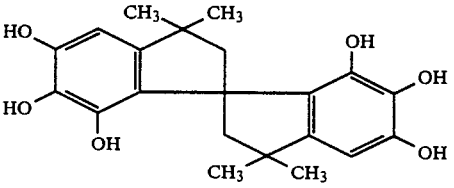
(CVII-6)
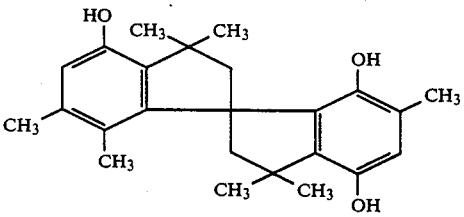
(CVII-7)
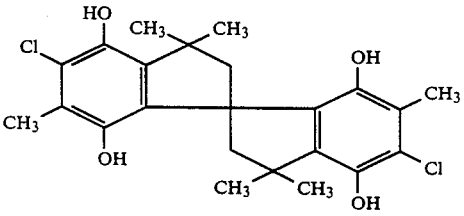

-continued (CVII-8)

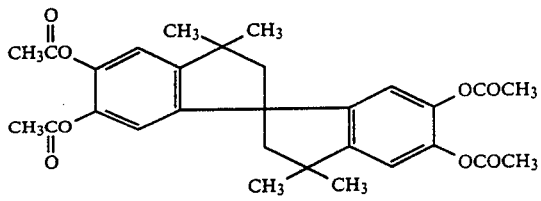

(CVII-9)

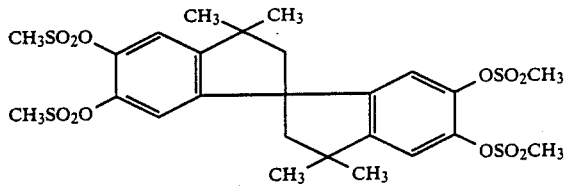

In the embodiments of this invention the effect of this invention is particularly large when the invention is applied to a high-sensitive silver halide emulsion layer.

The invention is particularly preferred when the invention is combined with a DIR coupler wherein the diffusibility of the releasing group thereof is particularly large or a DIR coupler having a timing controlling group as described in Japanese Patent Application (OPI) No. 145,135/'79 and British Pat. No. 2,072,363.

Gelatin is advantageously used as a binder or a protective colloid for silver halide photographic emulsions in this invention but other hydrophilic colloids can be used.

For example, there are proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc.; sugar derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc.

Gelatin used in this invention include lime-treated gelatin, acid-treated gelatin, the enzyme-treated gelatin as described in "Bull. Soc. Sci. Phot. Japan"; No. 16, 30 (1966), and hydrolyzed products or enzyme-decomposed products of gelatin.

Gelatin derivatives used in this invention include the products obtained by gelatin and various compounds such as acid halides, acid anhydrides, isocyanates, bromoacetic acid, alkanesultones, vinylsulfonamides, maleinimide compounds, polyalkylene oxides, epoxy compounds, etc. Other practical examples of gelatin derivatives used in this invention are described in U.S. Pat. Nos. 2,614,928; 3,132,945; 3,186,846; and 3,312,553; British Pat. Nos. 861,414; 1,033,189; and 1,005,784; and Japanese Patent Publication No. 26,845/'67, etc.

The foregoing gelatin graft polymers include products obtained by grafting homopolymers or copolymers of vinylic monomers such as acrylic acid, methacrylic acid, esters or amides of these acids, acrylonitrile, styrene, etc., to gelatin. In particular, graft polymers of gelatin and polymers having a compatibility with gelatin to some extent, such as the polymers of acrylic acid, methacrylic acid, acrylamide, methacrylamide, hydroxyalkyl methacrylamide, etc. Practical examples of the graft polymers of gelatin are described in, for example, U.S. Pat. Nos. 2,763,625; 2,831,767; 2,956,884, etc.

Typical examples of the synthetic hydrophilic polymers used as a binder or a protective colloid in this invention are described in West German Patent Application (OLS) No. 2,312,708; U.S. Pat. Nos. 3,620,751 and 3,879,205; and Japanese Patent Publication No. 7561/'68.

For silver halide photographic emulsions used in this invention, silver bromide, silver iodobromide, silver iodochloro-bromide, silver chlorobromide, or silver chlorode may be used as the silver halide. The preferred silver halide is silver iodobromide containing 2 mole% or more silver iodide.

The silver halide photographic emulsions used in this invention can be prepared by the methods described in, for example, P. Glafkides, "Chimie et Physique Photographique", (published by Paul Montel Co., 1967); G. F. Duffin; "Photographic Emulsion Chemistry", (published by the Focal Press Co., 1966); and V. L. Zelikman et al; "Making and Coating Photographic Emulsion", (published by The Focal Press, 1964). That is, the photographic emulsions may be prepared by an acid method, a neutral method, an ammonia method, etc., as well as for the system of reacting a soluble silver salt and a soluble halide, a one-side mixing method, a simultaneous mixing method, or the combination of both methods may be utilized in this invention. Also, a method of forming silver halide particles under the presence of excessive silver ions (so-called back mixing method) can be used. Also, as one system of the simultaneous mixing method, a so-called controlled double jet method, i.e., a method of maintaining pAg in a liquid phase, in which silver halide is formed, at a constant value can be used. By the method, a silver halide emulsion having regular crystal form and almost uniform grain size is obtained.

Two or more silver halide emulsions formed separately may be mixed to provide the silver halide emulsion used in this invention.

The formation of the silver halide grains or the physical ripening thereof may be performed in the presence of a cadmium salt, a zinc salt, a lead salt, a thallium salt, an iridium salt, or the complex salts thereof, a rhodium salt or the complex salts thereof, or an iron salt or the complex salts.

The silver halide photographic emulsion layers or other hydrophilic colloid layers of the photographic materials of this invention may contain various surface active agents for the purposes of improving coating properties, static prevention, slipping property, emulsified dispersion, adhesion prevention, and photographic properties (e.g., development acceleration, contrast increasing, sensitization, etc.).

Examples of such surface active agents are nonionic surface active agents such as saponin (steroid series), alkylene oxide derivatives (e.g., polyethylene glycol, a polyethylene glycol/polypropylene glycol condensate, polyethylene glycol alkyl esters, polyethylene glycol alkylaryl ethers, polyethylene glycol esters, polyethylene glycol sorbitan esters, polyalkylene glycol alkylamines, polyalkylene glycol alkylamides, polyethylene oxide addition products of silicone, etc.), glycidol derivatives (e.g., alkenylsuccinic acid polyglyceride, alkylphenol polyglyceride, etc.), fatty acid esters of polyhydric alcohols, alkyl esters of sugar, etc.; anionic surface active agents having an acid group such as a carboxy group, a sulfo group, a phospho group, a sulfuric acid ester group, a phosphoric acid ester group, etc., such as alkyl carboxylates, alkyl sulfonates, alkyl benzenesulfonates, alkyl naphthalenesulfonates, alkylsulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; amphoteric surface active agents such as aminoacids, aminoalkylsulfonic acids, aminoalkylsulfuric acid esters, aminoalkylphosphoric acid esters, alkylbetaines, amine oxides, etc.; and cationic surface active agents such as alkylamine salts, aliphatic or aromatic quaternary ammonium salts, heterocyclic quaternary ammonium salts (e.g., pyridinium, imidazolium, etc.), phosphonium salts of sulfonium salts containing an aliphatic or heterocyclic ring.

The silver halide photographic emulsion layers of the photographic materials of this invention may contain polyalkylene oxides or the derivatives thereof such as the ethers, esters, amines, etc., thioether compounds, thiomorpholines, quaternary ammonium salts, urethane derivatives, urea derivatives, imidazole derivatives, 3-pyrazolidones, etc., for the purposes of sensitivity increase, contrast increase, or development acceleration. Practical examples of such additives are described in, for example, U.S. Pat. Nos. 2,400,532; 2,423,549; 2,716,062; 3,617,280; 3,772,021; and 3,808,003 and British Pat. No. 1,488,991, etc.

The silver halide photographic layers of the photographic materials of this invention may further contain a dispersion of a water-insoluble or water sparingly soluble synthetic polymer for improving the dimensional stability of the photographic materials. As such synthetic polymers, there are polymers of monomers such as alkyl (metha)acrylate, alkoxyalkyl (metha)acrylate, glycidyl (metha)acrylate, (metha)acrylamide, vinyl ester (e.g., vinyl acetate), acrylonitrile, olefin, styrene, etc., solely or as a combination of them or polymers of these monomers and acrylic acid, methacrylic acid, $\alpha,\beta$-unsaturated dicarboxylic acid, hydroxyalkyl (metha)acrylate, sulfoalkyl (metha)acrylate, styrenesulfonic acid, etc. Practical examples of such polymers are described in, for example, U.S. Pat. Nos. 2,376,005; 2,739,137; 2,853,457; 3,062,674; 3,411,911; 3,488,708; 3,525,620; 3,607,290; 3,635,715; and 3,645,740 and British Pat. Nos. 1,186,699 and 1,307,373.

For photographic processing of the photographic materials of this invention, known processes and known processing solutions as described in "Research Disclosure", No. 176, pages 28–30 (RD-17643) can be employed. the photographic processing may be a photographic process for forming silver image (black and white processing) or a photographic process for forming dye image (color photographic processing). The processing temperature is usually selected in a range of 18° C. to 50° C. but may be lower than 18° C. or higher than 50° C.

As a fix solution, an ordinary fix composition can be used. As the fixing agent, a thiosulfate, a thiocyanate, or an organic sulfur compound which is known to have an effect as a fixing agent can be used. The fix solution may contain a water-soluble aluminum salt as a hardening agent.

For forming dye images, an ordinary process can be employed. For example, there are a nega-posi process as described in, for example, "Journal of the Society of Motion Picture and Television Engineers", Vol. 61, 667–701 (1953); a color reversal process of obtaining a positive dye image by developing the photographic material by a developer containing a black and white developing agent to form a negative silver image, applying thereto at least one uniform light exposure or other proper fogging treatment, and then performing a color development; and a silver dye bleaching process of developing photographic emulsion layers containing dyes after light exposure to form a silver image and bleaching dyes with the silver image as a bleaching catalyst.

A color developer used in this invention is generally composed of an aqueous alkaline solution containing a color developing agent. As the color developing agent used in this invention, there are known primary aromatic amine developing agents (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoamidoethylaniline, 4-amino-3-methyl-N-ethyl-N-$\beta$-methoxyethylaniline, etc.).

Other examples of the color developing agent used in this invention are described in, for example, L. F. A. Mason; "Photographic Processing Chemistry", pages 226–229 (published by Focal Press Co., 1966); U.S. Pat. Nos. 2,193,015 and 2,592,364; and Japanese Patent Application (OPI) No. 64,933/'73.

The color developer used in this invention may further contain, if necessary, a pH buffer, a development inhibitor, or antifoggant. Also, the color developer may further contain, if necessary, a water softener, a preservative, an organic solvent, a development accelerator, a dye-forming coupler, a fogging agent, an auxiliary developing agent, a tackifier, a polycarboxylic acid series chelating agent, an antioxidant, etc.

Practical examples of these additives are described in, for example, "Research Disclosure" (RD-17643) and U.S. Pat. No. 4,083,723; West Germany Patent Application (OLS) No. 2,622,950, etc.

The silver halide photographic emulsion layers are bleached after color development. The bleach process may be performed together with a fix process or may be performed separately from the fix process. As the bleaching agent, the compounds of a multivalent metal such as iron (III), cobalt (III), chromium (VI), copper (II), etc., peracids, quinones, nitroso compounds.

Examples of the bleaching agent are ferricyanides; dichromates; organic complex salts of iron (III) or cobalt (III), for example, the complex salts of aminopolycarboxylic acids such as ethylenediamine tetraacetic acid, nitrilo triacetic acid, 1,3-diamino-2-propanol tetraacetic acid, etc., or organic acids such as citric acid, tartaric acid, malic acid, etc., and the aforesaid metal; persulfates; permanganates; nitrosophenol, etc. In these materials sodium iron (III) ethylenediamine tetraacetic acid, potassium ferricyanate, and ammonium iron (III) ethylenediamine tetraacetic acid are particularly useful. The ethylenediamine tetraacetic acid iron (III) complex salt can be profitably used for a bleach solution or a blix solution.

The bleach solution of blix solution may further contain the bleach accelerator as described in, for example, U.S. Pat. Nos. 3,042,520 and 3,241,966; Japanese Patent Publication Nos. 8506/'70 and 8836/'80; the thiol compound as described in Japanese Patent Application (OPI) No. 65,732/'78, and other various additives.

The silver halide photographic emulsions used in this invention may be spectrally sensitized by methine dyes, etc.

Useful sensitizing dyes are described in, for example, German Pat. No. 929,080; U.S. Pat. Nos. 2,493,748; 2,503,776; 2,519,001; 2,912,329; 3,656,959; 3,672,897; and 4,025,349; British Pat. No. 1,242,588; and Japanese Patent Publication No. 14,030/'69.

These sensitizing dyes may be used solely or as a combination of them and a combination of dye sensitizers is frequently used for super dye sensitization. Typical examples of such combinations are described in U.S. Pat. Nos. 2,688,545; 2,977,229; 3,397,060; 3,522,052; 3,527,641; 3,617,293; 3,628,964; 3,666,480; 3,672,898; 3,679,428; 3,814,609; 4,026,707; British Pat. No. 1,344,281; Japanese Patent Publication Nos. 4936/'68 and 12,375/'78; and Japanese Patent Application (OPI) Nos. 110,618/'77 and 109,925/'77.

This invention can be applied to a multilayer multicolor photographic material having at least two differently sensitized photographic emulsion layers on a support. A multilayer natural color photographic material usually has at least one red-sensitive silver halide emulsion layer, at least one green-sensitive silver halide emulsion layer, and at least one blue-sensitive silver halide emulsion layer on a support. The disposed order of these emulsion layers can be desirably selected according to the necessity. Usually, a red-sensitive emulsion layer contains a cyan-forming coupler, a green-sensitive emulsion layer contains a magenta-forming coupler, and a blue-sensitive emulsion layer contains a yellow-forming coupler but as the case may be, other combinations are employed.

The photographic materials of this invention may contain inorganic or organic hardening agents. Examples of such hardening agents are chromium salts (e.g., chromium alum, chromium acetate, etc.), aldehydes (e.g., formaldehyde, glyoxal, glutaraldehyde, etc.), N-methylol compounds (e.g., dimethylol urea, methylol dimethylhydantoin, etc.), dioxane derivatives (2,3-dihydroxydioxane, etc.), active vinyl compounds (e.g., 1,3,5-triacryloyl-hexahydro-S-triazine, 1,3-vinylsulfonyl-2-propanol, etc.), active halogen compounds (e.g., 2,4-dichloro-6-hydroxy-S-triazine, etc.), mucohalogenic acids (e.g., mucochloric acid, mucophenoxychloric acid, etc.), etc., and they may be used solely or as a combination of them.

The photographic materials of this invention may further contain ultraviolet absorbents in the hydrophilic colloid layers. Examples of ultraviolet absorbents used in this invention are a benzotriazole compound substituted by an aryl group, a 4-thiazolidone compound, a benzphenone compound, a cinnamic acid compound, butadiene compound, a benzoxazole compound, and ultraviolet absorptive polymers. These ultraviolet absorbents may be fixed in the foregoing hydrophilic colloid layers.

Practical examples of the ultraviolet absorbents are described in, for example, U.S. Pat. Nos. 3,533,794; 3,314,794; and 3,352,681; Japanese Patent Application (OPI) No. 2784/'71; U.S. Pat. Nos. 3,705,805; 3,707,375; 4,045,229; 3,700,455; and 3,499,762; West German Patent Publication (DAS) No. 1,547,863, etc.

The photographic materials of this invention may further contain water-soluble dyes as filter dyes or for other various purposes such as irradiation prevention, etc. Examples of such dyes are oxonole dyes, hemioxonole dyes, styryl dyes, merocyanine dyes, cyanine dyes, and azo dyes. In these dyes oxonole dyes, hemioxonole dyes, and merocyanine dyes are particularly useful.

Practical examples of the water-soluble dyes are described in British Pat. Nos. 546,708; 584,609; 1,265,842; and 1,410,488; U.S. Pat. Nos. 2,274,782; 2,286,714; 2,526,632; 2,606,833; 2,956,879; 3,148,187; 3,247,127; 3,481,927; 3,575,704; 3,653,905; and 3,718,472.

The silver halide photographic emulsion layers of the photographic materials of this invention may further contain known color-forming couplers, i.e., compounds capable of coloring by the oxidative coupling with an aromatic primary amine developing agent (e.g., a phenylenediamine derivative, an aminophenol derivative, etc.) in color development in addition to the dye diffusible type couplers. Examples of these color-forming couplers used in this invention are such magenta couplers as 5-pyrazolone couplers, pyrazolone benzimidazole couplers, cyanoacetylcumarone couplers, open chain acylacetonitrile couplers, etc.; such yellow couplers as acylacetamido couplers (e.g., benzoylacetanilides, pivaloylacetanilides, etc.), etc.; and such cyan couplers as phenol couplers, naphthol couplers, etc. It is desirable that these couplers are non-diffusible couplers having a hydrophobic group called as ballast group in each of the molecules. These couplers may be 4-equivalent couplers or two-equivalent couplers with respect to silver ions. Also, these couplers may be colored couplers having a color correction effect or couplers releasing a development inhibitor with the progress of development (so-called DIR couplers). Furthermore, the silver halide photographic emulsions may contain colorless DIR couplers which form a colorless coupling reaction product and release a development inhibitor.

For incorporating couplers in the silver halide emulsion layers in this invention, a known method such as the method described in, for example, U.S. Pat. No. 2,322,027 can be used. For example, the coupler is dissolved in a high-boiling solvent such as a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., diethyllaurylamide, etc.), a fatty acid ester (e.g., dibutoxyethyl succinate, dioctyl azelate, etc.), a trimesic acid ester (e.g., tributyl trimesate, etc.), etc., or an organic solvent having a boiling point of about 30° C. to 150° C., such as a lower alkyl acetate (e.g., ethyl acetate, butyl acetate, etc.), secondary butyl alcohol, methyl isobutyl ketone, $\beta$-ethoxyethyl acetate, methylcellosolve acetate, etc., and then the solution is dispersed in a hydrophilic colloid. A mixture of the foregoing high-boiling organic solvent and the low-boiling organic solvent may be used in the aforesaid method.

Also, the dispersing method by a polymer as described in Japanese Patent Publication No. 39,853/'76 and Japanese Patent Application (OPI) No. 59,943/'76 can be used.

When the coupler has an acid group such as a carboxylic acid group or a sulfonic acid group, the coupler is added to a hydrophilic colloid as an alkaline aqueous solution of the coupler.

The invention will further be described more practically by the following examples. However, the scope of the invention is not limited to these examples.

EXAMPLE 1

A multilayer color photographic material was prepared by forming the layers having the following compositions on a cellulose triacetate film.

The 1st layer: Antihalation layer:

A gelatin layer containing black colloidal silver.

The 2nd layer: Interlayer:

A gelatin layer containing an emulsified dispersion of 2,5-di-t-octylhydroquinone.

The 3rd layer: 1st red-sensitive silver halide emulsion layer:

Silver iodobromide emulsion (silver iodide: 5 mole%—silver coverage of 1.79 g/m$^2$.

Sensitizing dye I—$6\times10^{-5}$ mole per mole of silver.

Sensitizing dye II—$1.5\times10^{-5}$ mole per mole of silver.

Coupler A—0.04 mole per mole of silver.

Coupler C—0.003 mole per mole of silver.

Coupler D—0.0006 mole per mole of silver.

The 4th layer: 2nd red-sensitive silver halide emulsion layer:

Silver iodobromide emulsion (silver iodide: 4 mole%)—silver coverage of 1.4 g/m$^2$.

Sensitizing dye I—$3\times10^{-5}$ mole per mole of silver.

Sensitizing dye II—$1.2\times10^{-5}$ mole per mole of silver.

Coupler E—0.02 mole per mole of silver.

Coupler C—0.0016 mole per mole of silver.

The 5th layer: Interlayer:

Same as the 2nd layer.

The 6th layer: 1st green-sensitive silver halide emulsion layer:

Silver iodobromide emulsion (silver iodide: 4 mole%)—silver coverage of 1.5 g/m$^2$.

Sensitizing dye III—$3\times10^{-5}$ mole per mole or silver.

Sensitizing dye IV—$1\times10^{-5}$ mole per mole of silver.

Coupler B—0.05 mole per mole of silver.

Coupler M—0.008 mole per mole of silver.

Coupler D—0.0015 mole per mole of silver.

The 7th layer: 2nd green-sensitive silver halide emulsion layer:

Silver iodobromide emulsion (silver iodide: 5 mole%)—silver coverage of 1.6 g/m$^2$.

Sensitizing dye III—$2.5\times10^{-5}$ mole per mole of silver.

Sensitizing dye IV—$0.8\times10^{-5}$ mole per mole of silver.

Coupler B—0.02 mole per mole of silver.

Coupler N—0.003 mole per mole of silver.

Coupler D—0.0003 mole per mole of silver.

The 8th layer: Yellow filter layer:

A gelatin layer containing yellow colloidal silver and an emulsified dispersion of 2,5-di-t-octylhydroquinone.

The 9th layer: 1st blue-sensitive silver halide emulsion layer:

Silver iodobromide emulsion (silver iodide: 6 mole%)—silver coverage of 1.5 g/m$^2$.

Coupler Y—0.25 mole per mole of silver.

The 10th layer: 2nd blue-sensitive silver halide emulsion layer.

Silver iodobromide emulsion (silver iodide: 6 mole%)—silver coverage of 1.1 g/m$^2$.

Coupler Y—0.06 mole per mole of silver.

The 11th layer: Protective layer:

A gelatin layer containing trimethyl methacrylate particles (diameter of about 1.5μ).

The sample thus prepared was named "Sample 101".

The compounds used for preparing the sample are as follows:

Sensitizing dye I: anhydro-5,5'-dichloro-3,3'-di-(γ-sulfopropyl)-9-ethyl-thiacarbocyanine hydroxide.pyridinium salt.

Sensitizing dye II: anhydro-9-ethyl-3,3'-di-(γ-sulfopropyl)-4,5,4',5'-dibenzothiacarbocyanine hydroxide.triethylamine salt.

Sensitizing dye III: anhydro-9-ethyl-5,5'-dichloro-3,3'-di-(γ-sulfopropyl)oxacarbocyanine.sodium salt.

Sensitizing dye IV: anhydro-5,6,5',6'-di{β-[β-(γ-sulfopropoxyethoxy]ethyl}imidazolocarbocyanine hydroxide.sodium salt.

Coupler A

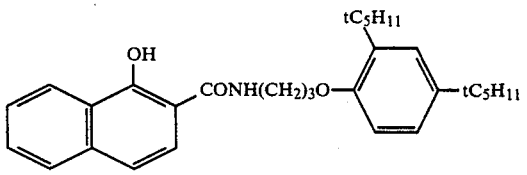

Coupler E

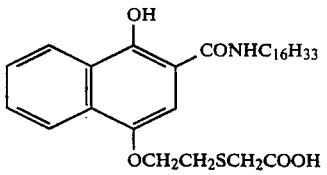

-continued

Coupler B

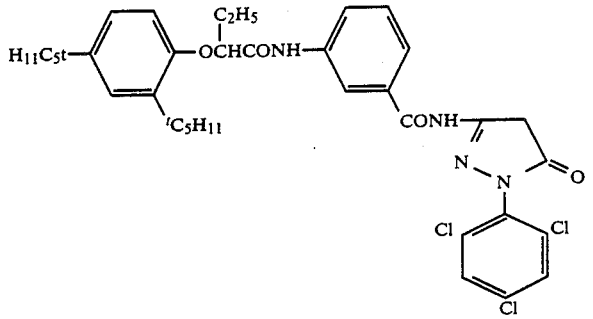

Cuopler C

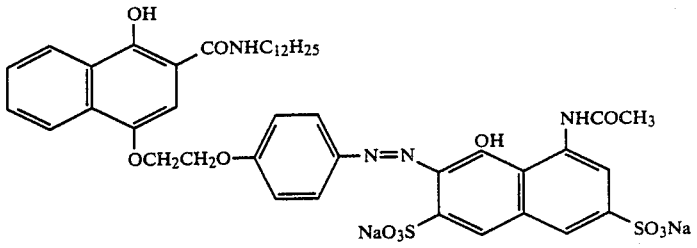

Coupler D

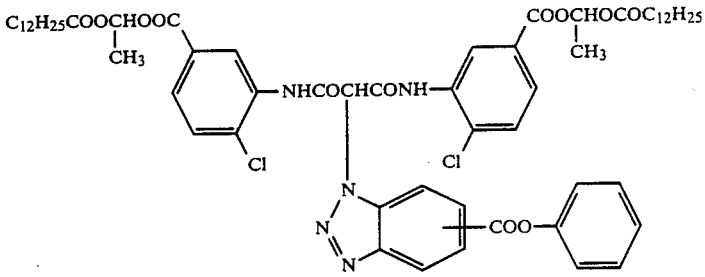

Coupler M

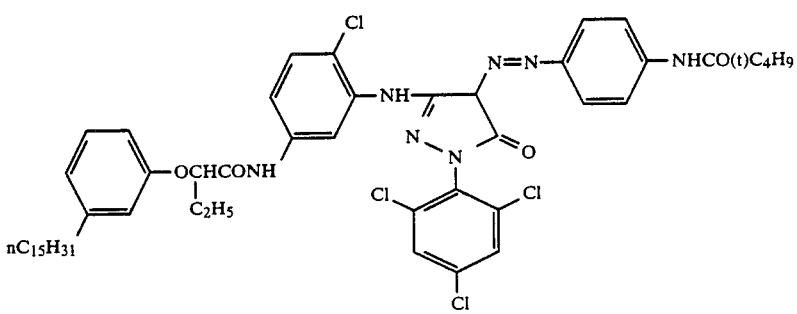

Coupler Y

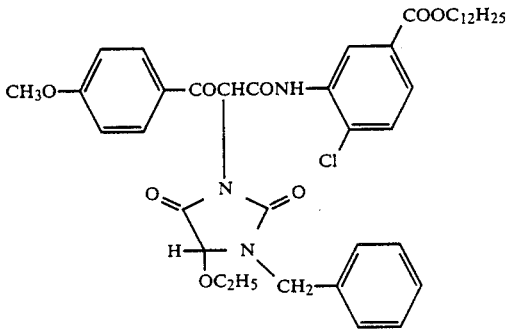

Sample 102: The sample was prepared by following the same procedure as the case of preparing sample 101 except that Coupler M-12 was added in place of Coupler M in an amount of 70 mole% of Coupler M.

Sample 103: The sample was prepared by following the same procedure as the case of preparing sample 102 by adding Compound CI-11 to the 7th layer in an amount of 10% of Coupler M-12.

Sample 104: The sample was prepared by following the same procedure as the case of preparing sample 103 except that an equimolar amount of Compound CI-60 was added in place of Compound CI-11.

Sample 105: The sample was prepared by following the same procedure as the case of preparing sample 103 except that Compound CI-83 was added in an amount of 5 mole times that of Compound CI-11 in place of Compound CI-11.

When samples 101 to 105 thus prepared were wedge-exposed to white light, they showed almost same sensitivity and same gradation.

The development procedures used in this case were as follows and each process was performed at 38° C.

1. Color development—3 min. 15 sec.
2. Bleach—6 min. 30 sec.
3. Wash—3 min. 15 sec.
4. Fix—6 min. 30 sec.
5. Wash—3 min. 15 sec.
6. Stabilization—3 min. 15 sec.

The compositions of the processing solutions used in the foregoing processes were as follows.

| Color developer: | |
|---|---|
| Sodium nitrotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-Ethyl-N-β-hydroxyethylamino)-2 methyl-aniline sulfate | 4.5 g |
| Water to make | 1 liter |
| Bleach solution: | |
| Ammonium bromide | 160.0 g |
| Aqueous ammonia (28%) | 25.0 ml |
| Sodium ethylenediaminetetraacetate iron salt | 130.0 g |
| Glacial acetic acid | 14 ml |
| Water to make | 1 liter |
| Fix solution: | |
| Sodium tetrapolyphosphate | 2.0 g |
| Sodium sulfite | 4.0 g |
| Ammonium thiosulfate (70%) | 175.0 ml |
| Sodium hydrogensulfite | 4.6 g |
| Water to make | 1 liter |
| Stabilization solution: | |
| Formalin | 8.0 ml |
| Water to make | 1 liter |

The granularity of the magenta color image of each of these samples was evaluated by the conventional rms method. The evaluation of granularity by the rms method is well known as described in, for example, "The Theory of the Photographic Process"; 4th Edition, page 619. The size of the measuring aperture was 10μ.

Also, a 110 size film was prepared from each of samples 101 to 105 in order to be subjected to a practical photographing test. The photographed image was then printed in cabinet size, and a mental evaluation of the graininess was performed.

Furthermore, the Wiener spectrum (measuring aperture was 10μ) was measured on the granularity of the magenta color image of each of samples 101 to 105.

The rms granularity and the mental evaluation results are summarized in Table 1.

TABLE 1

| Sample | Rms value of magenta image D = Dmin + 0.2 | D = Dmin + 0.7 | Mental evaluation |
|---|---|---|---|
| Sample 101 (comparison) | 0.051 | 0.043 | The granularity was seen. |
| Sample 102 (comparison) | 0.043 | 0.040 | Large mottles having a tinge of magenta were seen and the granularity was rather badly seen. |
| Sample 103 (the invention) | 0.042 | 0.040 | Neither mottle nor granularity was seen |
| Sample 104 (the invention) | 0.041 | 0.039 | Neither mottle nor granularity was seen. |
| Sample 105 (the invention) | 0.042 | 0.039 | Neither mottle nor granularity was seen. |

The results in Table 1 show that sample 102 using a dye diffusible type coupler has an improved granularity in the rms granularity as compared to that of sample 101 but in sample 102, masses of dyes are seen at a high density area, which deteriorate the visual sensation of the granularity.

This can be explained by the Wiener spectrum shown in FIG. 1 of the accompanying drawings.

That is, FIG. 1 shows that the Wiener spectrum of sample 102 using a dye diffusible type coupler is disposed at a higher position than that of sample 101 at a lower frequency region than 3 cycles/mm, which shows overlapping of dyes in sample 102. On the other hand, in sample 103 using a dye diffusible type coupler together with the competing compound according to this invention, the Wiener spectrum thereof is disposed at a lower position than that of sample 101 in the whole region, which coincides with the good mental sensation of the granularity.

EXAMPLE 2

A comparison sample 202 was prepared by following the same procedure as when preparing sample 101 except that the coupler shown in Table 2 was used for the 4th layer of sample 101 in Example 1 in place of Coupler E and the grain size of the silver iodobromide of the layer was slightly increased so that the sensitivity and gradation of the silver halide emulsion became the same as those of sample 101. Also, samples 203 to 206 of this invention were prepared by adding each of the competing compounds shown in Table 2 to sample 202 and increasing the grain size of the silver halide emulsion so that the sensitivity and gradation thereof became the same as those of sample 101.

Each of samples 101 and samples 202 to 206 was processed as in Example 1, the rms granularity and the Wiener spectrum of each sample thus processed were measured, and also the mental evaluation of the graininess of each sample was performed. The results thus obtained are shown in Table 2.

TABLE 2

| Sample | Cyan coupler* | Competing compound* (amount**) | Rms value of cyan image D = Dmin + 0.2 | D = Dmin + 0.7 | Mental evaluation |
|---|---|---|---|---|---|
| Sample 101 (comparison) | Coupler E | — | 0.051 | 0.042 | The granularity was seen. |
| Sample 202 (comparison) | Coupler C-2 | — | 0.045 | 0.037 | Large mottles having a tinge of cyan were seen and the granularity was rather badly seen. |
| Sample 203 (Invention) | Coupler C-2 | CI-11 (10 mole %) | 0.041 | 0.036 | Neither large mottle nor granularity was seen. |
| Sample 204 (Invention) | Coupler C-2 | CIV-1 (30 mole %) | 0.040 | 0.035 | Neither large mottle nor granularity was seen. |
| Sample 205 (Invention) | Coupler C-2 | CIV-1 (20 mole %) | 0.041 | 0.036 | Neither large mottle nor granularity was seen. |
| Sample 206 (Invention) | Coupler C-2 | CVII-2 (20 mole %) | 0.041 | 0.036 | Neither large mottle nor granularity was seen. |

*These compounds were used for the 4th layer.
**The addition amount based on the amount of Coupler C-2.

From the results shown in Table 2, it is clear that in sample 202 using the dye diffusible type cyan coupler, the rms granularity may be small but large mottles formed rather reduce the visual sensation of the granularity thereof. This evaluation coincides with that in the Wiener spectrum of FIG. 1, the spectrum of sample 202 is above that of sample 101 at a lower frequency region than 5 cycles/mm. On the other hand, in sample 203 using the dye diffusible type cyan coupler together with the competing compound, the spectrum of sample 203 is below those of samples 101 and 102 at the whole frequency region, which coincides with the metal evaluation shown in Table 2.

EXAMPLE 3

Sample 302 was prepared by following the same procedure as the case of preparing sample 101 in Example 1 except that the coupler described in Table 3 was used for the 10th layer of sample 101 in place of Coupler Y and the sensitivity and the gradation of the emulsion in the layer were controlled so that they became same as those of sample 101 by slightly increasing the grain size of the emulsion. Also, sample 303 of the invention was prepared by further adding the competing compound shown in Table 3 to the 10th layer in sample 302. In this case the sensitivity and the gradation of the emulsion in the layer were controlled so that they became the same as those of sample 302 by changing the grain size of the emulsion.

Each of samples 101, 302, and 303 was processed as in Example 1, the rms value and the Wiener spectrum of each sample were measured and the mental evaluation of the granularity was also performed. The results are shown in Table 3.

TABLE 3

| Sample | Yellow coupler* | Competing compound | Rms value D = Dmin + 0.2 | D = Dmin + 0.7 | Mental evaluation |
|---|---|---|---|---|---|
| Sample 101 (comparison) | Coupler Y | — | 0.162 | 0.124 | The granularity was seen. |
| Sample 302 (comparison) | Coupler Y-6 | — | 0.132 | 0.117 | Mottles having a tinge of yellow were seen. |
| Sample 303 (Invention) | Coupler Y-6 | CI-11 (10 mole %**) | 0.125 | 0.118 | Neither mottles nor granularity was seen. |

*These compounds were used for the 10th layer.
**The addition amount based on the yellow coupler Y-6.

Figure 3:
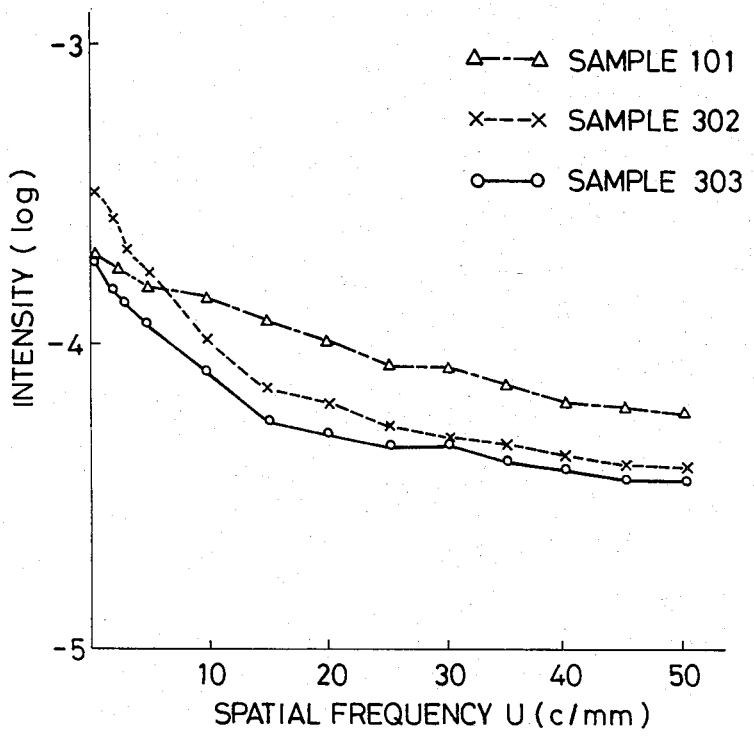
FIG. 3 is a graph showing the Wiener spectra of yellow images of samples 101, 302, and 303 at the density $D_{min}+0.2$.

From the results shown in Table 2, it is clear that in sample 302 using the dye diffusible type yellow coupler, the rms granularity may be small but large mottles formed reduce the granularity. This evaluation coincided with that in the Wiener spectrum shown in FIG. 3, the spectrum of sample 302 is above that of sample 101 at a lower frequency region than 5 cycles/mm. On the other hand, in sample 303 of this invention using the diffusible dye type yellow coupler together with the competing compound, the Wiener spectrum thereof is below that of samples 101 and 302 at the whole frequency region, which coincides with the mental evaluation shown in Table 3.

EXAMPLE 4

Sample 401, i.e., a multilayer color photographic material was prepared by forming the layers having the following compositions on a cellulose triacetate film support.

The 1st layer: Antihalation layer:

Same as the 1st layer of the color photographic material in Example 1.

The 2nd layer: Interlayer:

Same as the 2nd layer of the color photographic material in Example 1.

The 3rd layer: Red-sensitive low-speed silver halide emulsion layer:

Silver iodobromide emulsion (silver iodide: 5 mole%, mean grain size: 0.7μ)—silver coverage of 1.3 g/m$^2$.

Sensitizing dye I—$6\times10^{-5}$ mole per mole of silver.

Sensitizing dye II—$1.5\times10^{-5}$ mole per mole of silver.

Coupler A—0.05 mole per mole of silver.

Coupler C—0.003 mole per mole of silver.

Coupler D—0.003 mole per mole of silver.

The 4th layer: Red-sensitive intermediate speed silver halide emulsion layer:

Silver iodobromide emulsion (silver iodide: 5.5 mole%, mean grain size: 0.9μ)—silver coverage of 1.3 g/m$^2$.

Sensitizing dye I—$5\times10^{-5}$ mole per mole of silver.
Sensitizing dye II—$1.2\times10^{-5}$ mole per mole of silver.
Coupler A—0.04 mole per mole of silver.
The 5th layer: Red-sensitive high-speed silver halide emulsion layer.
Silver iodobromide emulsion (silver iodide: 8 mole%, mean grain size: 1.2μ)—silver coverage of 1.5 g/m².
Sensitizing dye I—$5\times10^{-5}$ mole per mole of silver.
Sensitizing dye II—$1.2\times10^{-5}$ mole per mole of silver.
Coupler C-2—0.015 mole per mole of silver.
The 6th layer: Interlayer:
Same as the 2nd layer of the color photographic material in Example 1.
The 7th layer: Green-sensitive low-speed silver halide emulsion layer:
Silver iodobromide emulsion (silver iodide: 5 mole%, mean grain size: 0.7μ)—silver coverage of 0.7 g/m².
Sensitizing dye III—$3\times10^{-5}$ mole per mole of silver.
Sensitizing dye IV—$1\times10^{-5}$ mole per mole of silver.
Coupler B—0.06 mole per mole of silver.
Coupler M—0.012 mole per mole of silver.
Coupler D—0.01 mole per mole of silver.
The 8th layer: Green-sensitive intermediate-speed silver halide emulsion layer:
Silver iodobromide emulsion (silver iodide: 5 mole%, mean grain size: 0.9μ)—silver coverage of 2.5 g/m².
Sensitizing dye III—$2.5\times10^{-5}$ mole per mole of silver.
Sensitizng dye IV—$0.8\times10^{-5}$ mole per mole of silver.
Coupler B—0.05 mole per mole of silver.
Coupler M—0.005 mole per mole of silver.
Coupler D—0.001 mole per mole of silver.
The 9th layer: Green-sensitive high-speed silver halide emulsion layer.
Silver iodobromide emulsion (silver iodide: 8 mole%, mean grain size: 1.1μ)—silver coverage of 3.0 g/m².
Sensitizing dye III—$2.1\times10^{-5}$ mole per mole of silver.
Sensitizing dye IV—$0.7\times10^{-5}$ mole per mole of silver.
Coupler B—0.0125 mole per mole of silver.
Coupler M—0.002 mole per mole of silver.
The 10th layer: Yellow filter layer:
Same as that of the color photographic material in Example 1.
The 11th layer: Blue-sensitive low-speed silver halide emulsion layer:
Silver iodobromide emulsion (silver iodide: 5 mole%, mean grain size: 0.7μ)—silver coverage of 0.3 g/m².
Coupler Y—0.2 mole per mole of silver.
The 12th layer: Blue-sensitive intermediate-speed silver halide emulsion layer:
Silver iodobromide emulsion (silver iodide: 6 mole%, mean grain size: 0.9μ)—silver coverage of 0.4 g/m².
Coupler Y—0.1 mole per mole of silver.
The 13th layer: Blue-sensitive high-speed silver halide emulsion layer:
Silver iodobromide emulsion (silver iodide: 8.5 mole%, mean grain size: 1.4μ).
Coupler Y—0.05 mole per mole of silver.
The 14th layer: Protective layer:
Same as in Example 1.

Sample 402 was also prepared by the same manner as above while adding compound CI-11 to the 5th layer in sample 401 in an amount of 20 mole% of the amount of Coupler C-2 and increasing the grain size of the silver halide emulsion to equalize the sensitivity of the silver halide emulsion to that of sample 401.

Furthermore, sample 403 was prepared by the same manner as the case of preparing sample 402 while adding Compound CI-60 in place of Compound CI-11 in the same amount as that of Compound CI-11 used in sample 402.

Each of samples 401 to 403 thus prepared was processed as in Example 1, the granularity of the cyan color image thus formed was evaluated by the rms method, and also the granularity was evaluated on the cabinet size print obtained by a photographing practical test, the results thus obtained being shown in Table 4. The mental evaluation of the granularity of each sample thus processed was also performed and the results are shown in Table 4, which shows that the granularity is sufficiently improved in the samples of this invention in the mental evaluation.

TABLE 4

| Sample | Cyan coupler | Competing compound (amount*) | Rms value of cyan image Dmin + 0.2 | Mental evaluation |
|---|---|---|---|---|
| Sample 401 (comparison) | Coupler C-2 | — | 0.055 | Large mottles having a tinge of cyan were strikingly seen to give unpleasant mental sensation |
| Sample 402 (Invention) | Coupler C-2 | CI-11 (20 mole %) | 0.043 | Large mottles vanish to give smooth sensation. |
| Sample 403 (Invention) | Coupler C-2 | CI-60 (20 mole %) | 0.044 | Large mottles vanish to give smooth sensation |

*The addition amount based on the amount of Coupler C-2.

While the invention has been described in detail and with reference to specific embodiment thereof, it will be apparent to one skilled in the art that various changes and modifications can be made therein without departing from the spirit and scope thereof.

What is claimed is:

1. A silver halide color photographic material comprising a support having formed thereon a blue-sensitive silver halide emulsion layer, a green-sensitive silver halide emulsion layer, and a red-sensitive silver halide emulsion layer, at least one of said emulsion layers containing a non-diffusible coupler which forms a properly smearing diffusible dye upon reaction with the oxidation product of a color developing agent together with a substantially colorless competing compound which captures the oxidation product of a color developing agent wherein the colorless competing compound is represented by the general formula (CI)

(CI)

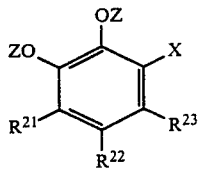

wherein X is a hydrogen atom, a substituted or unsubstituted alkyl group, a substituted or unsubstituted alkenyl group, a substituted or unsubstituted aryl group, or an —OZ group, wherein Z represents a hydrogen atom, an acyl group, and alkoxycarbonyl group, a carbamoyl group, a sulfonyl group, an alkyl group containing 1 to 20 carbon atoms, and an alkenyl group containing 2 to 22 carbon atoms or a methallyl group; $R^{21}$, $R^{22}$ and $R^{23}$ independently represent a hydrogen atom, a halogen atom, a cyano group, $—SO_2R^{24}$, $—COR^{24}$, a substituted or unsubstituted alkyl group containing 1 to 30 carbon atoms, a substituted or unsubstituted akenyl group containing 2 to 30 carbon atoms, a substituted or unsubstituted alkoxy group, a substituted or unsubstituted alkylthio group, a substituted or unsubstituted aryl group; and wherein $R^{24}$ is a hydroxy group, a substituted or unsubstituted aryl group containing 1 to 30 carbon atoms, a substituted or unsubstituted alkoxy group, a substituted or unsubstituted aryloxy group, or a substituted or unsubstituted amino group.

2. A silver halide color photographic material, as claimed in claim 1, wherein the non-diffusible coupler is represented by the general formula 1

$$(Cp)\text{—}Xa \qquad 1$$

wherein Cp is a diffusible coupler moiety; X is a group which is bonded to a coupling position of the coupler moiety and is released by reaction with the oxidation product of the color developing agent, said group being a moiety having a ballast group of 8–32 carbon atoms; and a is 1 or 2.

3. A silver halide color photographic material, as claimed in claim 2, wherein the non-diffusible coupler is present in an amount in the range of 0.005 mole to 0.2 mole per mole of silver.

4. A silver halide color photographic material as claimed in claim 3, wherein the non-diffusible coupler is present in an amount in the range of 0.01 mole to 0.05 mole per mole of silver.

5. A silver halide color photographic material as claimed in claim 3, wherein the colorless competing compound is present in an amount in the range of 1 mole% to 300 mole% of the non-diffusible coupler.

6. A silver halide color photographic material as claimed in claim 5, wherein the colorless competing compound is present in an amount in the range of 5 mole% to 100 mole% of the non-diffusible coupler.

7. A silver halide color photographic material as claimed in claim 5, wherein the non-diffusible coupler is represented by the following general formula (I) and (II)

(I)

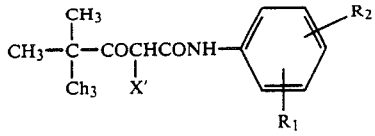

(II)

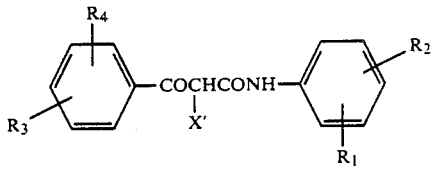

wherein $R_1$, $R_2$, $R_3$ and $R_4$ independently represent a hydrogen atom, a halogen atom, an alkyl group, and alkoxy group, aryloxy group, an acylamino group, a sulfonamino group, a carbamoyl group, a sulfamoyl group, an alkylthio group, an alkylsulfonyl group, an alkoxycarbonyl group, a ureido group, a cyano group, a carboxy group, a hydroxy group, or a sulfo group; wherein the total number of carbon atoms in $R_1$–$R_4$ is 10 or less, and X' represents a group having a balance group containing 8 to 32 carbon atoms which can be released by coupling with the oxidation product of an aromatic primary amino color developing agent.

8. A silver halide color photographic material as claimed in claim 7, wherein the colorless competing compound is a compound represented by the general formula (C II) and (C III)

(CII)

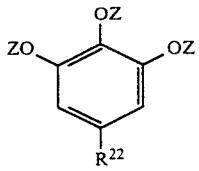

(CIII)

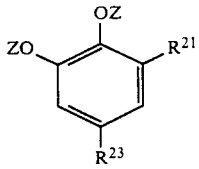

wherein Z, $R^{21}$ and $R^{23}$ are the same as claimed in claim 1, and $R^{22}$ is an alkoxycarbonyl group, an N-substituted carbamoyl group, an acyl group, a sulfonyl group, a cyano group, or a halogen atom.

9. A silver halide color photographic material as claimed in claim 1, wherein Z is a hydrogen atom, and acyl group or an alkoxycarbonyl group.

10. A silver halide color photographic material as claimed in claim 9, wherein Z is a hydrogen atom and $R^{22}$ is a alkoxycarbonyl group or an N-substituted carbamoyl group.

* * * * *